US009806425B2

(12) United States Patent
Apostolos et al.

(10) Patent No.: US 9,806,425 B2
(45) Date of Patent: Oct. 31, 2017

(54) HIGH PERFORMANCE LOW PROFILE ANTENNAS

(75) Inventors: John T. Apostolos, Lyndeborough, NH (US); Judy Feng, Nashua, NH (US); William Mouyos, Windham, NH (US); Benjamin McMahon, Nottingham, NH (US)

(73) Assignee: AMI RESEARCH & DEVELOPMENT, LLC, Windham, NH (US)

( * ) Notice: Subject to any disclaimer, the term of this patent is extended or adjusted under 35 U.S.C. 154(b) by 1045 days.

(21) Appl. No.: 13/372,122

(22) Filed: Feb. 13, 2012

(65) Prior Publication Data

US 2012/0274528 A1 Nov. 1, 2012

Related U.S. Application Data

(63) Continuation-in-part of application No. 13/357,448, filed on Jan. 24, 2012, now Pat. No. 8,710,360.

(60) Provisional application No. 61/441,720, filed on Feb. 11, 2011, provisional application No. 61/540,730, filed on Sep. 29, 2011, provisional application No. 61/502,260, filed on Jun. 28, 2011.

(51) Int. Cl.

| | |
|---|---|
| ***H01Q 13/20*** | (2006.01) |
| ***H01Q 13/22*** | (2006.01) |
| ***H01Q 13/24*** | (2006.01) |
| ***H01Q 13/28*** | (2006.01) |
| ***H01Q 21/00*** | (2006.01) |
| ***H01Q 21/06*** | (2006.01) |

(52) U.S. Cl.

CPC ..... *H01Q 13/20* (2013.01); *H01Q 13/22* (2013.01); *H01Q 13/24* (2013.01); *H01Q 13/28* (2013.01); *H01Q 21/0068* (2013.01); *H01Q 21/068* (2013.01)

(58) Field of Classification Search

CPC ..... H01Q 13/20
USPC ..... 343/785
See application file for complete search history.

(56) References Cited

U.S. PATENT DOCUMENTS

| | | | |
|---|---|---|---|
| 3,864,111 | A | 2/1975 | Kemp |
| 3,883,221 | A | 5/1975 | Rigrod |
| 3,898,585 | A | 8/1975 | Heidrich et al. |
| 4,357,486 | A | 11/1982 | Blieden |
| 4,445,050 | A | 4/1984 | Marks |
| 4,574,161 | A | 3/1986 | Marks |
| 4,932,743 | A | 6/1990 | Isobe et al. |

(Continued)

FOREIGN PATENT DOCUMENTS

| | | |
|---|---|---|
| DE | 19958750 | 7/2001 |
| EP | 2 348 342 | 7/2011 |

(Continued)

OTHER PUBLICATIONS

International Search Report and the Written Opinion, date of mailing Aug. 6, 2012 for International Application No. PCT/US2012/022717 for AMI Research & Development, LLC International Filing Date Jan. 26, 2012, 17 pages.

(Continued)

*Primary Examiner* — Dameon E Levi
*Assistant Examiner* — Andrea Lindgren Baltzell
(74) *Attorney, Agent, or Firm* — VLP Law Group LLP

(57) ABSTRACT

A leaky travelling wave array of elements provide a broadband radio frequency antenna.

7 Claims, 36 Drawing Sheets

(56) References Cited

U.S. PATENT DOCUMENTS

| | | | | |
|---|---|---|---|---|
| 5,005,022 | A * | 4/1991 | Blaisdell | H01Q 19/06 343/753 |
| 5,090,017 | A | 2/1992 | Mendenhall et al. | |
| 5,177,352 | A | 1/1993 | Carson | |
| 5,235,589 | A | 8/1993 | Yokomori | |
| 5,315,676 | A | 5/1994 | Sunagawa | |
| 5,390,046 | A | 2/1995 | Gesell et al. | |
| 5,420,947 | A | 5/1995 | Li | |
| 5,637,358 | A | 6/1997 | Otoshi | |
| 5,652,816 | A | 7/1997 | Minami et al. | |
| 5,726,662 | A | 3/1998 | Hopwood | |
| 5,781,676 | A | 7/1998 | Okada | |
| 6,016,122 | A | 1/2000 | Malone et al. | |
| 6,198,453 | B1 | 3/2001 | Chew | |
| 6,281,766 | B1 | 8/2001 | Malone et al. | |
| 6,421,021 | B1 | 7/2002 | Rupp et al. | |
| 6,434,303 | B1 | 8/2002 | Temkin | |
| 6,501,093 | B1 | 12/2002 | Marks | |
| 6,730,389 | B2 | 5/2004 | Voeltzel | |
| 6,847,155 | B2 | 1/2005 | Schwartz et al. | |
| 6,898,352 | B2 | 5/2005 | Deliwala | |
| 6,993,236 | B1 | 1/2006 | Gunn, III | |
| 7,095,928 | B2 | 8/2006 | Blauvelt et al. | |
| 7,157,989 | B2 | 1/2007 | Kim | |
| 7,190,326 | B2 | 3/2007 | Voeltzel | |
| 7,408,507 | B1 | 8/2008 | Paek et al. | |
| 7,456,803 | B1 | 11/2008 | Sievenpiper | |
| 7,949,210 | B2 | 5/2011 | Durfee et al. | |
| 7,972,522 | B2 | 7/2011 | Jordana et al. | |
| 8,160,404 | B2 | 4/2012 | Pan et al. | |
| 2001/0035842 | A1 | 11/2001 | Apostolos | |
| 2001/0048396 | A1 | 12/2001 | Apostolos | |
| 2002/0171078 | A1 | 11/2002 | Eliasson et al. | |
| 2003/0020658 | A1 | 1/2003 | Apostolos | |
| 2003/0118306 | A1 | 6/2003 | Deliwala | |
| 2004/0022050 | A1 | 2/2004 | Yamashita et al. | |
| 2004/0045932 | A1 | 3/2004 | Kochergin et al. | |
| 2005/0008294 | A1 | 1/2005 | Park et al. | |
| 2005/0264452 | A1* | 12/2005 | Fujishima | H01Q 1/243 343/700 MS |
| 2007/0240757 | A1 | 10/2007 | Ren et al. | |
| 2008/0138013 | A1* | 6/2008 | Parriaux | G02B 5/1814 385/37 |
| 2008/0186508 | A1 | 8/2008 | Kiesel et al. | |
| 2008/0187011 | A1 | 8/2008 | Kiesel et al. | |
| 2008/0271776 | A1* | 11/2008 | Morgan | F21S 11/00 136/246 |
| 2009/0066597 | A1 | 3/2009 | Yang et al. | |
| 2009/0245725 | A1 | 10/2009 | Yonekura | |
| 2010/0001917 | A1* | 1/2010 | Manasson | H01Q 13/28 343/785 |
| 2010/0060521 | A1* | 3/2010 | Hayes | H01Q 1/38 342/368 |
| 2010/0108133 | A1 | 5/2010 | Bhagavatula et al. | |
| 2010/0139749 | A1 | 6/2010 | Mapel | |
| 2010/0139769 | A1 | 6/2010 | Mapel | |
| 2010/0200044 | A1 | 8/2010 | Zaban et al. | |
| 2010/0212717 | A1 | 8/2010 | Whitlock et al. | |
| 2011/0023941 | A1 | 2/2011 | Didomenico | |
| 2011/0030757 | A1 | 2/2011 | Lin et al. | |
| 2011/0220172 | A1 | 9/2011 | Layton | |
| 2011/0232211 | A1 | 9/2011 | Farahi | |
| 2011/0253198 | A1 | 10/2011 | Patrick et al. | |
| 2011/0255824 | A1 | 10/2011 | Lee et al. | |
| 2012/0204937 | A1 | 8/2012 | Apostolos | |
| 2012/0204954 | A1 | 8/2012 | Apostolos | |
| 2012/0204955 | A1 | 8/2012 | Apostolos | |
| 2012/0204956 | A1 | 8/2012 | Apostolos | |
| 2012/0205525 | A1 | 8/2012 | Apostolos | |

FOREIGN PATENT DOCUMENTS

| | | | | |
|---|---|---|---|---|
| GB | WO 2008/087388 | A1 * | 7/2008 | H01Q 19/13 |
| JP | 2009/053458 | A | 3/2009 | |
| WO | WO 2009/002943 | | 3/2009 | |
| WO | WO 2009/064888 | | 5/2009 | |
| WO | WO 2011/119179 | | 9/2011 | |
| WO | WO 2007/138589 | | 12/2013 | |

OTHER PUBLICATIONS

International Search Report and the Written Opinion, date of mailing Jun. 22, 2012 for International Application No. PCT/US2012/024872 for AMI Research & Development, LLC International Filing Date Feb. 13, 2012, 11 pages.

Vaccaro, S., et al. "Making Planar Antennas Out of Solar Cells" Electronic Letters, 38:17, Aug. 15, 2002.

Lin, C., et al. "Nano-Structured and Micro-Structured Semiconductors for Higher Efficiency Solar Cells"; IEEE Singapore, 4 pages, Dec. 8-11, 2008.

Tentzeris, M. "IMS2011 Abstract Card"; TU1 C: RFID Technologies and Applications, Jun. 7, 2011.

Sarehraz, M., et al. "Rectenna Developments for Solar Energy Collection"IEEE, pp. 78-81; Aug. 8, 2005.

Grover, S., "Traveling-Wave Metal/Insulator/Metal Diodes for Improved Infrared Bandwidth and Efficiency of Antenna-Coupled Rectifiers" IEEE Transactions of Nanotechnology; 9:6, Nov. 2010.

Bozzetti, M., et al "Analysis and Design of a Solar Rectenna" IEEE, pp. 2001-2004; Nov. 10, 2010.

Baba, T. "Monolithic Integration of an Arrow-Type Demultiplexer and Photodetector in the Shorter Wavelength Region" Journal of Lightwave Technology 8:1; Jan. 1990.

Tangonan, G.L., et al. "Tapered gap prism couplers for high index materials" Applied Optics; 16:7 pp. 1795-1796; Jul. 1977.

Stevenson, Richard, "Photovoltaics take a load off soldiers," Technology Solar Cells, Copyright Institute of Physics and IOP Publishing Ltd, 2006, 3 pages.

Tentzeris, M. "IMS2011 Abstract Card"; TU1C: RFID Technologies and Applications, Jun. 7, 2011.

Hozzetti, M., et al "Analysis and Design of a Solar Rectenna" IEEE, pp. 2001-2004; Nov. 10, 2010.

Transmittal of International Preliminary Report on Patentability for International Application No. PCT/US12/24872, International Filing Date Feb. 13, 2012 by AMI Research & Development, LLC for High Performance, Low-Profile Antennas, 39 pages.

Mashall & Gordon, "Rectenna harvesting of sunlight", Feb. 24, 2012.

Office Action U.S. Appl. No. 13/357,451, Oct. 11, 2012.

Guenther "Modern Optics", John Wiley & Sons 1990.

Milonni et al. "Laser Physics" John Wiley & Sons 2010, pp. 331-400.

Waveguide (electromagnetism). (Jun. 14, 2015). In Wikipedia, The Free Encyclopedia. Retrieved 19:40, Jul. 30, 2015, from https://en.wikipedia.org/w/index.php?title=Waveguide_(electromagnetism)&oldid=666974677.

Skolnik, Merrill, Radar Handbook, McGraw Hill Book Company, New York, 1970, pp. 8-7-8-13.

Extended European Search Report mail date Dec. 5, 2014 for European Application No. 12744769.6 filed on Feb. 13, 2012 by AMI Research & Development, LLC, 7 pages.

The Penguin Dictionary of Physics, Second Edition, abridgement of Longman's Dictionary of Physics (revised edition 1991), London, England, see definition of "propagation coefficient", pp, 368-369.

* cited by examiner

HIGH PERFORMANCE LOW PROFILE ANTENNAS

RELATED APPLICATION(S)

This application claims the benefit of U.S. Provisional Application No. 61/441,720, filed on Feb. 11, 2011, U.S. Provisional Application No. 61/502,260 filed on Jun. 28, 2011 and is a continuation-in-part of U.S. application Ser. No. 13/357,448, filed Jan. 24, 2012.

The entire teachings of the above application(s) are incorporated herein by reference.

This application also claims the benefit of U.S. Provisional Application No. 61/540,730 filed Sep. 29, 2011.

TECHNICAL FIELD

The present disclosure relates to an antenna solution to address the need for a multiband, low-profile antenna for satellite and other wideband (Ku/K/Ka/Q) communications applications by using an innovative dielectric traveling wave surface waveguide array.

BACKGROUND

Commercially available Ku Band or higher frequency antenna solutions such as dish antennas are bulky and unwieldy causing significant drag. In addition, the Commercial off the Shelf (COTS) solutions require large areas of real estate, which for vehicular applications introduces high installation complexity and cost.

SUMMARY

To address this need, we have devised a dielectric traveling wave surface wave structure that can be arranged into various types of arrays to yield a cost-effective wideband/multiband antenna that can handle high power.

The geometry of the structure consists of dielectric waveguides with scattering elements on the waveguide surface to operate in a leaky propagation mode.

In optional configurations, to scan the beam along the waveguide axis, the propagation constant of the waveguides is changed using a reconfigurable layered structure in the waveguide.

Wide bandwidth is achieved by optionally embedding chirped Bragg layered structures adjacent the reconfigurable propagation layer in the waveguide to provide equalization of scan angle over frequency. Existing materials and layer deposition processes are used to create this waveguide structure. The design uses low-loss surface wave modes and low-loss dielectric material which provide optimum gain performance which is key to handling power and maintaining efficiency.

In one implementation, an antenna includes a waveguide having a top surface, a bottom surface, a feed (excitation) end and a load end. One or more scattering features are disposed on the top surface of the waveguide or within the waveguide. The scattering features achieve operation in a leaky propagation mode.

The scattering features may take various forms. They may, for example, be a metal structure such as a rod formed on or in the waveguide. In other embodiments the scattering features may be one or more rectangular slots formed on or in the waveguide. In other embodiments the scattering features may be grooves formed in the top surface of the waveguide. The slot and/or grooves may have various shapes.

The scattering feature that provides leaky mode propagation may also be a continuous wedge. The wedge is preferably formed of a material having a higher dielectric constant than the waveguide.

The waveguide may be a dielectric material such as silicon nitride, silicon dioxide, magnesium fluoride, titanium dioxide or other materials suitable for leaky wave mode propagation at the desired frequency of operation.

The scattering feature dimensions and spacing may vary with their respective position along the waveguide. For example, adjusting the spacing of the scattering features may assist with the leaky mode coupling to waves propagating within the waveguide, allowing the waveguide to leak a portion of power along the its entire length, and improving efficiency or bandwidth.

In other embodiments, selected scattering features may be positioned orthogonally with respect to one another. This permits the antenna to operate at multiple polarizations, such as horizontal/vertical or left/right hand circular.

The scattering features can be located at each element position in an array of scattering features or may be arranged as a set of one-dimensional line arrays with the features of alternating line arrays providing different polarizations.

In still other arrangements, a wavelength correction element adds linear delay to incident energy received or transmitted by the antenna. This permits a resulting beam direction of the apparatus to be independent of the wavelength. This correction element may be formed from a set of discrete features embedded in the waveguide with a periodically modulated spacing; or it may be embodied as a material layer that tapers from a thin section at the collection end to a thick section near the detection end.

The leaky propagation mode of operation may be further enhanced by a coupling layer placed between the waveguide and the correction element. With this arrangement the coupling layer has a dielectric constant that changes from the excitation end to the load end, therefore providing increased coupling between the waveguide and the correction layer as a function of the distance along the main axis of the waveguide. This function may also be provided by a coupling layer decreasing in thickness from end to end. Such a coupling layer may equalize the horizontal and vertical mode propagation velocities in the waveguide.

In still other arrangements, the waveguide may itself be formed of two or more layers. Adjacent layers may be formed of materials with different dielectric constants. Gaps may be formed between the layers with a control element provided to adjust a size of the gaps. The gap spacing control element may be, for example, a piezoelectric, electroactive material or a mechanical position control. Such gaps may further control the beamwidth and direction.

In still other arrangements, a multilayer waveguide may provide frequency selective surfaces to assist with maintaining a constant beam shape over a range of frequencies. The spacing in such an arrangement between the layers may follow a chirp relationship.

In yet another arrangement, a layer disposed adjacent the waveguide may provide quadratic phase weighting along a primary waveguide axis. This may further assist in maintaining a constant beamwidth. The quadratic phase weight may be imposed by a layer having a thickness that tapers from end to end, or may be provided in other ways such as by subsurface elements formed within the waveguide that vary in length, spacing and/or depth from the surface.

The arrays may be combined to provide beam steering, or a single beam for multiple frequency bands, or multiple beams for a single frequency band.

In still other arrangements, the surface features may themselves be radiating elements, such as an array of patch antennas. The patch antennas may be fed through slots in a ground plane. Rows of these patch antennas may be orthogonally positioned.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 1-2 is a high level block diagram of the antenna array.

FIG. 1-3 is a conceptual diagram of one implementation of a the antenna array using rods with discrete scattering elements to operate in a leaky propagation mode.

FIG. 1-4 illustrates dispersion curves for various lengths of a dielectric rod.

FIG. 1-5 is an implementation using orthogonal surface scattering elements.

FIG. 1-6 is an example implementation of a one-dimensional line array as a dielectric substrate having surface scattering features and optional additional layers to operate in a leaky propagation mode.

FIG. 1-7 is a specific embodiment as a single dielectric rod with V- and H-polarized scattering features.

FIG. 1-8 is another implementation where the leaky propagation mode is provided by a continuous leaky wedge structure.

FIG. 2-1 is a slab wave guide embodiment with a group of line arrays having co-located cross-polarized scattering features.

FIG. 2-2 is a slab embodiment with a group of line arrays having alternating cross-polarized scattering features.

FIG. 2-3 shows a single feed arrangement for the slab.

FIG. 2-4 shows multiple feeds with transmit/receive modules for each subarray in the slab.

FIG. 3-1 is a detailed view of a dielectric waveguide with surface rectangular grooves that provide good single polarization efficiency.

FIG. 3-2 is another embodiment with a dielectric waveguide with surface triangular grooves provide good single polarization efficiency.

FIG. 3-3 illustrates metal strips in a cross configuration, offset from the centerline to provide co-located features to achieve V and H polarization.

FIG. 3-4 illustrates dielectric grooves in a cross configuration also providing collocated V and H polarization response.

FIG. 3-5 shows an implementation that increases the H-pol efficiency (and hence improving the axial ratio) by asymmetrically grooving the H portion of the element deeper into the waveguide, which also increases the coupling for the H pol portion.

FIG. 3-6 separates the V and H pol grooves along the waveguide surface, which further increases radiation efficiency from each scattering element because it minimizes cross coupling between adjacent pairs.

FIG. 3-7 shows vertically separate V and H pol elements, which can provide increased efficiency over collocated "crosses"; while the V and H elements are not technically collocated here, separating these vertically allows the V and H pol elements to use the same sun-facing surface area.

FIG. 3-8 shows how triangular grooves can be combined and collocated for two adjacent multi-polarized line arrays in a single subarray.

FIG. 3-9 is an implementation where the scattering features obtain circular polarization with interleaved metal strips.

FIG. 3-10 implements metal strips imprinted as dielectric triangular or rectangular grooves to provide V and H pol response.

FIG. 3-11 rotates the orientation of the triangular or rectangular grooves to provide a mixed V and H pol response.

FIG. 3-12 has scattering features implemented as raised triangle structures to provide a single polarization response.

FIG. 3-13 is a similar implementation using raised right angle trapezoid structures to also provide a single polarization response.

FIG. 3-14 shows raised interleaved crosses to provide V and H pol response.

FIG. 3-15 is an implementation with offset longitudinal slots providing H pol response along the long axis.

FIG. 4 illustrates a correction wedge used on the radiating side of a rod-type linear waveguide to provide linear delay to the scattering features.

FIG. 5 illustrates the correction wedge with low dielectric constant gap to improve performance.

FIG. 6 is an alternate embodiment where a surface structure can also provide linear delay.

FIG. 7 shows a waveguide formed of multiple layers having a chirped spacing to provide frequency selective surfaces (FSS).

FIG. 8 is a more detailed view of the waveguide having surface scattering features and chirped Bragg FSS layers.

FIG. 9 is a tapered dielectric layer to provide quadratic phase weighting.

FIG. 10 is another way to achieve quadratic phase weighting.

FIG. 11 is a way to provide effective dielectric constant control by changing a gap size between multiple dielectric layers.

FIG. 12 is a wideband/scanning configuration.

FIG. 13 shows reconfigurable chirped Bragg structures.

FIG. 14 illustrates the resulting equalized propagation constant.

FIG. 15 is another embodiment of the antenna array providing both azimuth and elevation beam control.

DETAILED DESCRIPTION OF PREFERRED EMBODIMENTS

A description of example embodiments follows.

Transceiver System Diagram

Figure 1:
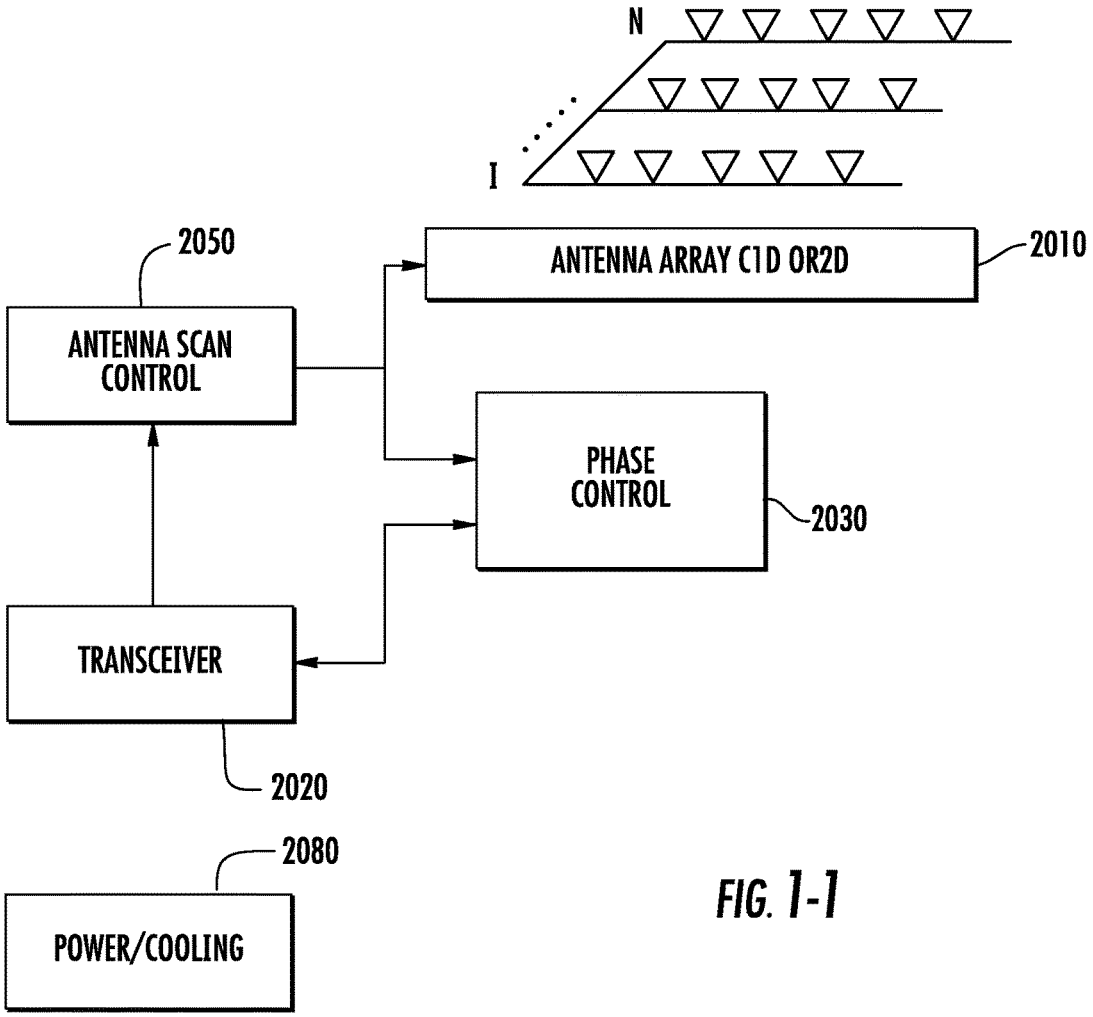
FIG. 1-1 is a high level block diagram of a transceiver system that uses a radio frequency (RF) antenna array operating in a leaky mode.

In a preferred embodiment herein as shown in FIG. 1-1, a transceiver system 2000 includes an antenna array 2010. The antenna array 2010 may be a line array (a linear array of elements) or it may be a two dimensional array (that is, an arrangement having N linear arrays or N×N individual elements). Transceiver 2020 provides radio signals to be transmitted by and/or received from the antenna array 2010. A phase shift/control module 2030 is typically disposed between the transceiver and the antenna array. A scan control block 2050 may contain additional circuitry such as digital controllers to control phasing, layer spacing and other aspects of the antenna array 2010 as more fully described below. A power supply, cooling and other elements typically required of such antenna array systems are also provided 2080.

Figures 1, 2:
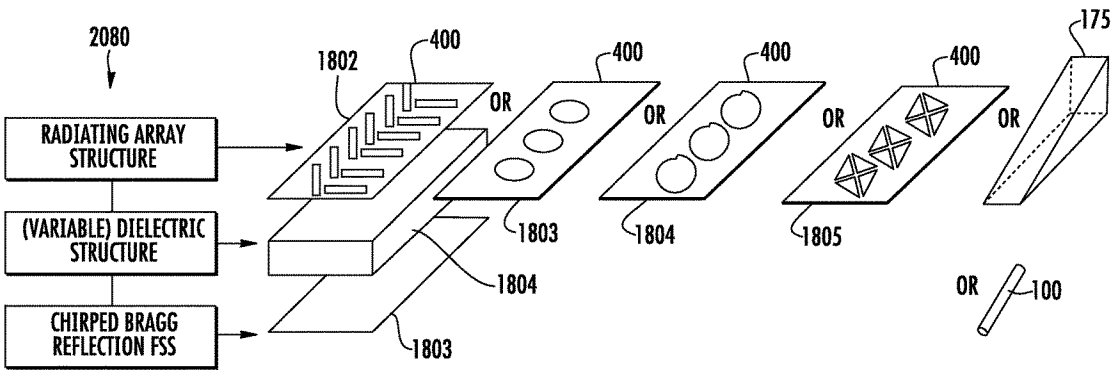

FIG. 1-2 is a general high level diagram of one embodiment of a dielectric travelling wave one dimensional line array 2010. The block diagram shows three (3) main structures: the Radiating Array Structure 1801 (that is, the collection of surface features 100, 175 or 400 enabling operation in leaky mode); an optional Variable Dielectric Structure 1802; and an optional Chirped Bragg Reflection Frequency Selective Surface (FSS) 1803. It should also be noted that illustrated here that certain types of surface features 1082, 1083, 1804, 1805 can be arranged as adjacent Left/Right Hand Circular Polariation (L/RHCP) elements, or in adjacent arrays as can be the Vertical/Horizontally polarizations as described more fully below.

Traveling Leaky Wave Array

In preferred embodiments herein, much improved efficiency is provided by a waveguide structure having surface scattering features arranged in one or more subarrays.

Single line source leaky wave antennas can be used to synthesize frequency scanning beams. The array elements are excited by a traveling wave progressing along the array line. Assuming constant phase progression and constant excitation amplitude, the direction of the beam is that of Equation (1).

$$\cos\theta=\beta(\text{line})/\beta-(\lambda m)/s \quad (1)$$

where s is the spacing between elements, m is the order of the beam, β (line) is the leaky mode propagation constant, and β is the free space propagation constant, and λ is the wavelength. Note the frequency dependence of the direction of the beam.

The antenna uses one or more dielectric surface waveguides with one or more arrays of one-dimensional, subarray feature (also called "rods" herein). Alternately, one large panel or "slab" of dielectric substrate can house multiple line or subarrays as will be described below.

Treating each of the subarrays as a transmitting case, the rods are excited at one end and the energy travels along the waveguide. The surface elements absorb and radiate a small amount of the energy until at the end of the rod whatever power is left is absorbed by one or more resistive loads at the load end. Operation in the receive mode is the inverse.

Figures 1, 2, 3:
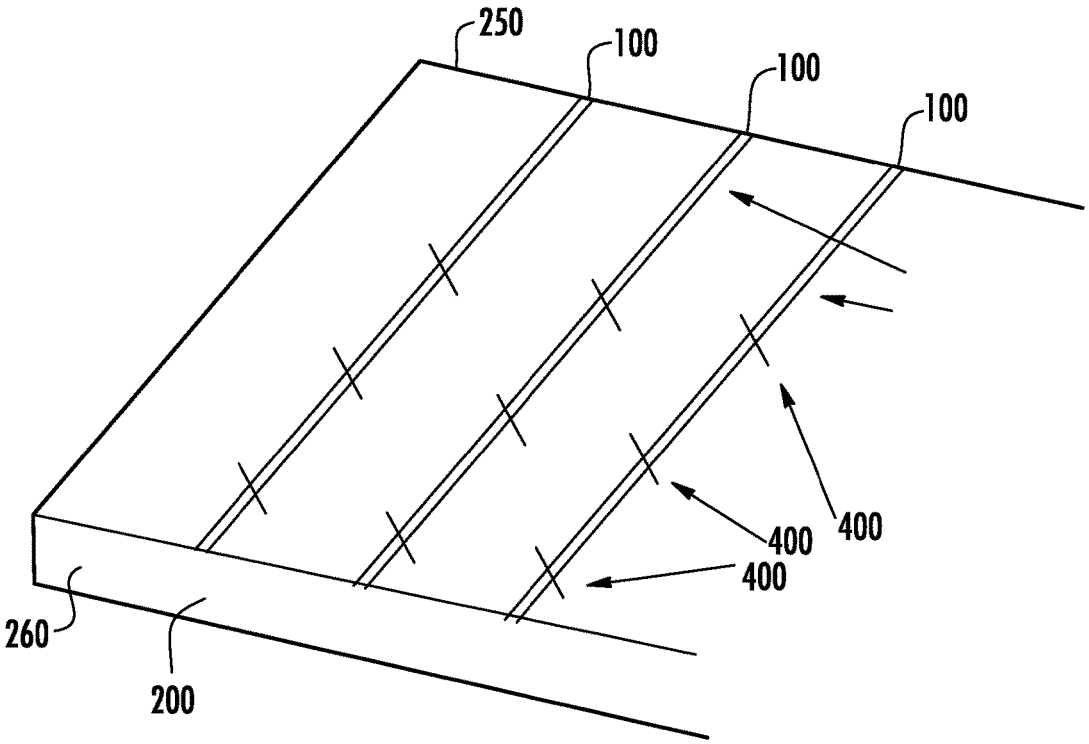
Figure 14:
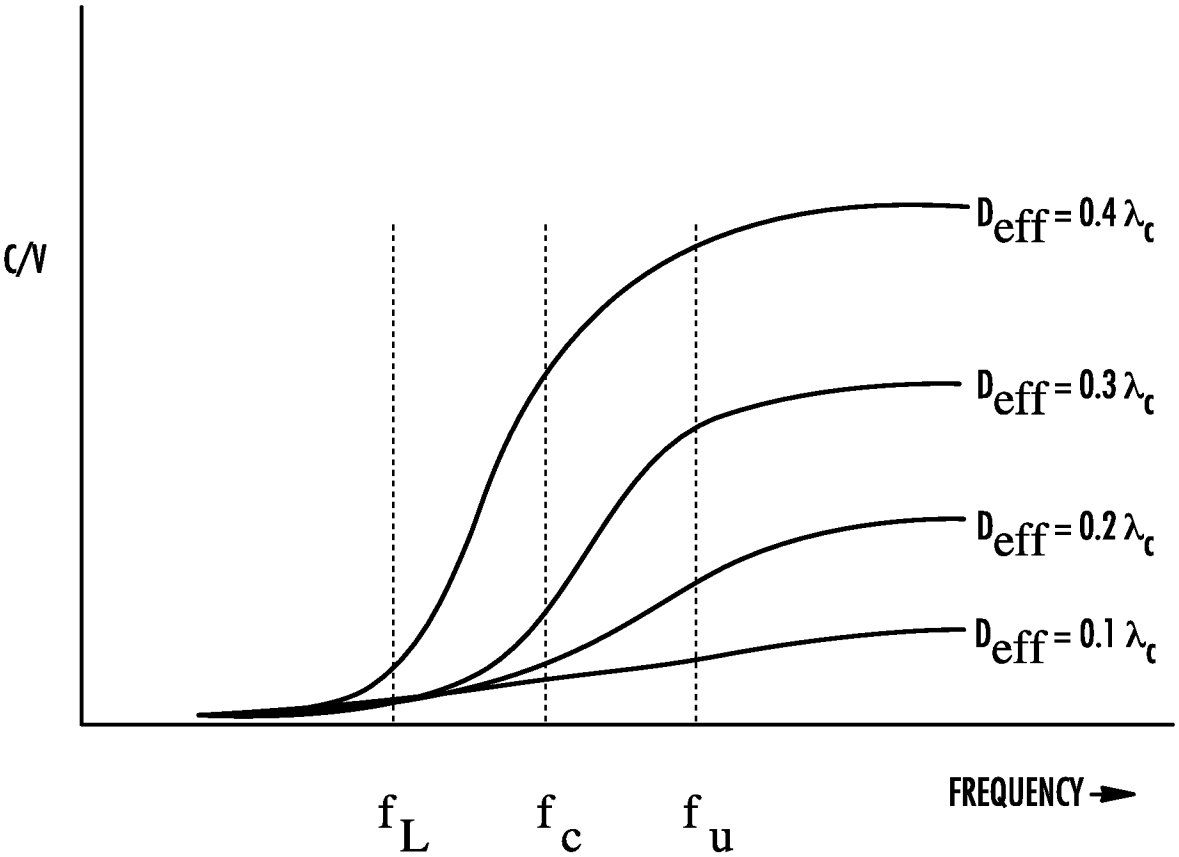

FIG. 1-3 illustrates the general geometry of one such structure, consisting of a dielectric waveguide 200 with the leaky mode scattering elements situated on the waveguide surface. In this arrangement, the scattering elements are a set of dielectric rods 100 disposed in parallel on the waveguide and extend from a resistive load end 250 to an excitation (or feed) end 260. Each dielectric rod 100 provides a single one-dimensional sub array; sets of two or more of dielectric rods 100 together provide a two-dimensional array.

Scattering elements 400 disposed along each of the rods 100 can be provided by conductive strips formed on, grooves cut in the surface of, or grooves entirely embedded into, the dielectric. The cross section of the rods may be square or circular and the scattering elements may take many different forms as will be described in more detail below.

The surface wave mode of choice is HE11 which has an exponentially decreasing field outside the waveguide and has low loss. The direction of the resulting beam is stated in Equation 2:

$$\cos(b)=C/V-\text{wavelength}/S \quad (2)$$

where C/V is the ratio of velocity in free space to that in the waveguide and S is the array element spacing.

The dispersion of the dielectric waveguide is shown in FIG. 1-4 for various diameters (D) of the rods 100. Fc is the center frequency of the desired band (Fu-FL). As the diameter changes from 0.1 λc wavelengths to 0.4 λc wavelengths, C/V in the rod increases with frequency. To scan the beam along the waveguide axis, the propagation constant of the waveguide can be changed by using a reconfigurable layered structure embedded in the waveguide as will be described below.

Line Array Implementations

As generally shown in FIG. 1-5, adjacent rods 100-1, 100-2 may have scattering features 400-1, 400-2 with alternate orientation(s) to provide orthogonal polarization (such as at 90 degrees to provide both horizontal (H) and vertical (V) polarization) or, say left and right hand circular polarization. This can maximize energy transfer in certain applications such as when the signals of interest are of known polarizations or even known to be unpolarized (randomized polarization).

FIG. 1-6 is a more detailed view of another implementation as a single line array 207, which may also be used as a building block of large two-dimensional arrays. This type of line array 207 consists of the dielectric waveguide 200 having scattering features 400 formed on the surface thereof to provide achieve operating in the leaky wave mode. The waveguide 200 is positioned on a substrate 202; one or more intermediate layers 204 may be disposed between the waveguide 200 and the substrate 202 as described more fully below. Sub arrays with orthogonal scattering elements can also be constructed individually. See FIG. 1-7 for an example, or as multiple line arrays located on or within a single dielectric panel or "slab" (see FIGS. 2-1 and 2-2 for examples).

Individual scattering element 400 design is dependent on the choice of construction and will be described in more detail below. It suffices here to say that the scattering elements and can be provided in a number of ways, such as conducting strips or non-conducting grooves embedded into the dielectric waveguide.

Collocated elliptically polarized elements provide polarization diversity to maximize the energy captured when it is randomly polarized. In one embodiment, that shown in FIG. 1-7, surface grooves 105 are co-located and orthogonally disposed with respect to embedded areas cut-out 107 of the dielectric at each position in the array. In this implementation, the width of the groove 105 in the upper surface of the waveguide 100 may change with position along the waveguide. If λ is the wavelength of operation of the sub array, the grove width may increment gradually, such as from λ/100 at the resistive load end 250 to λ/2 at the excitation end 260; the spacing between features may be constant, for example, λ/4.

FIG. 1-8 illustrates another way to implement leaky mode operation. Rather that individual scattering elements embedded in or on the waveguide 200, a continuous wedge structure 175 can be placed adjacent to the waveguide 200. The coupling between the waveguide 200 and the wedge 175 preferably increases as a function of distance along the waveguide 200 to facilitate constant amplitude along the radiation wave front. This may be accomplished by inserting a third layer 190 between the wedge 175 and the waveguide 200 with a decreasing thickness along the waveguide. This coupling layer 190, preferably formed of a material with yet another relative permittivity constant, ensures that the power leaked remains uniform along the length of the corresponding rod or slab.

The propagation constant in this "leaky wedge with waveguide" implementation of FIG. 1-8 determines the beam direction. To receive both horizontal and vertical polarization at a given beam direction, the propagation constants for horizontal and vertical modes of the waveguide-wedge configuration must be equal. There is a slight difference in the propagation constants for the H- and V-pol modes, which is manifested as a slight difference in the beam direction (3 degrees). The vertical beam is shifted more than the horizontal implying a slightly higher propagation constant. By applying a thin layer of high dielectric material on the bottom of the waveguide 200, the horizontal propagation constant can be increased relative to the vertical resulting in the beams coinciding.

Slab Configuration

As mentioned briefly above, groups of sub arrays can be disposed on a substrate formed as a two-dimensional panel or slab 300 as shown in FIG. 2-1. In these slab configurations, the sub arrays are orthogonally polarized to achieve horizontal (H) and vertical (V) polarization, either with collocated cross-polarized scattering features (such as in the FIG. 2-1 configuration), or alternating subarrays of cross-polarized scattering features (as in the FIG. 2-2 configuration). It is recognized that if collocated orthogonally polarized features are as efficient as a single polarization embodiment, the overall efficiency of the device will be greater by utilizing more sun-facing surface area with both polarizations. It should also be understood that the leaky mode surface feature can be provided by a continuous wedge that is wide enough to cover the entire slab, using the same principles as the leaky wedge 175 described for the linear subarray in FIG. 1-8.

The waveguide in these slab configurations operates in a TM and TE mode in the vertical and horizontal.

The FIG. 2-1 and FIG. 2-2 slab configurations may be formed on a silicon substrate (not shown) with the dielectric waveguide embodied as a set of waveguide core sections, including (a) a main core section 401 starting adjacent the load end 250 and extending to (b) a tapered section 402 and (c) a lossy core section 403 extending from the tapered section to the excitation feed end 260. Suitable dielectric materials include $Si_3N_4$, $SiO_2$, $MgF_2$, and $TiO_2$.

A cladding layer (not shown) may be disposed between the main waveguide section and/or tapered core section(s). The cladding layer may be used instead of a ground plane to minimize losses at higher pressure.

This slab implementation can provide ease of manufacture and better performance by eliminating edge effects.

Figures 1, 2, 3, 4, 5:
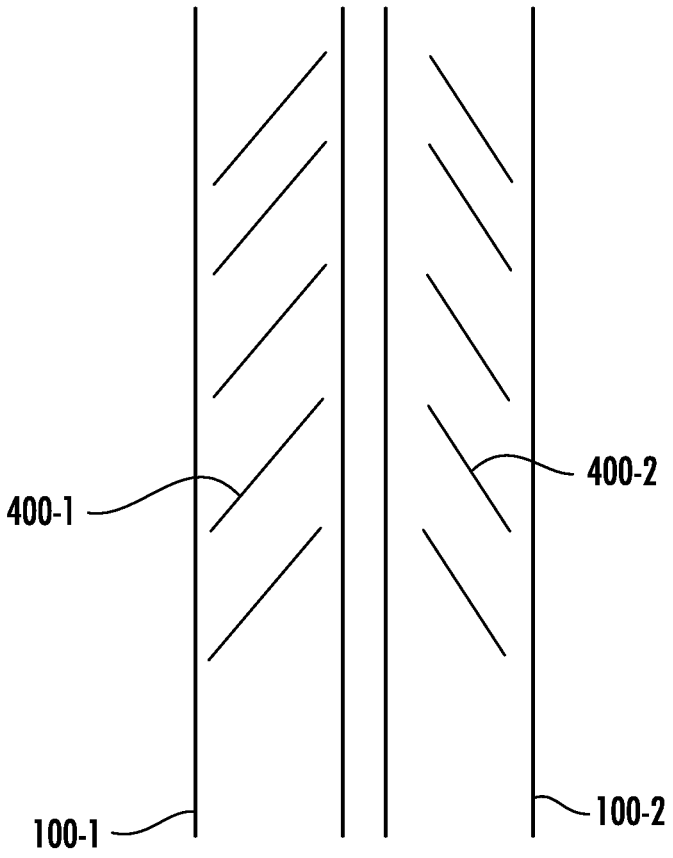
Figures 1, 2, 3, 4, 5, 6:
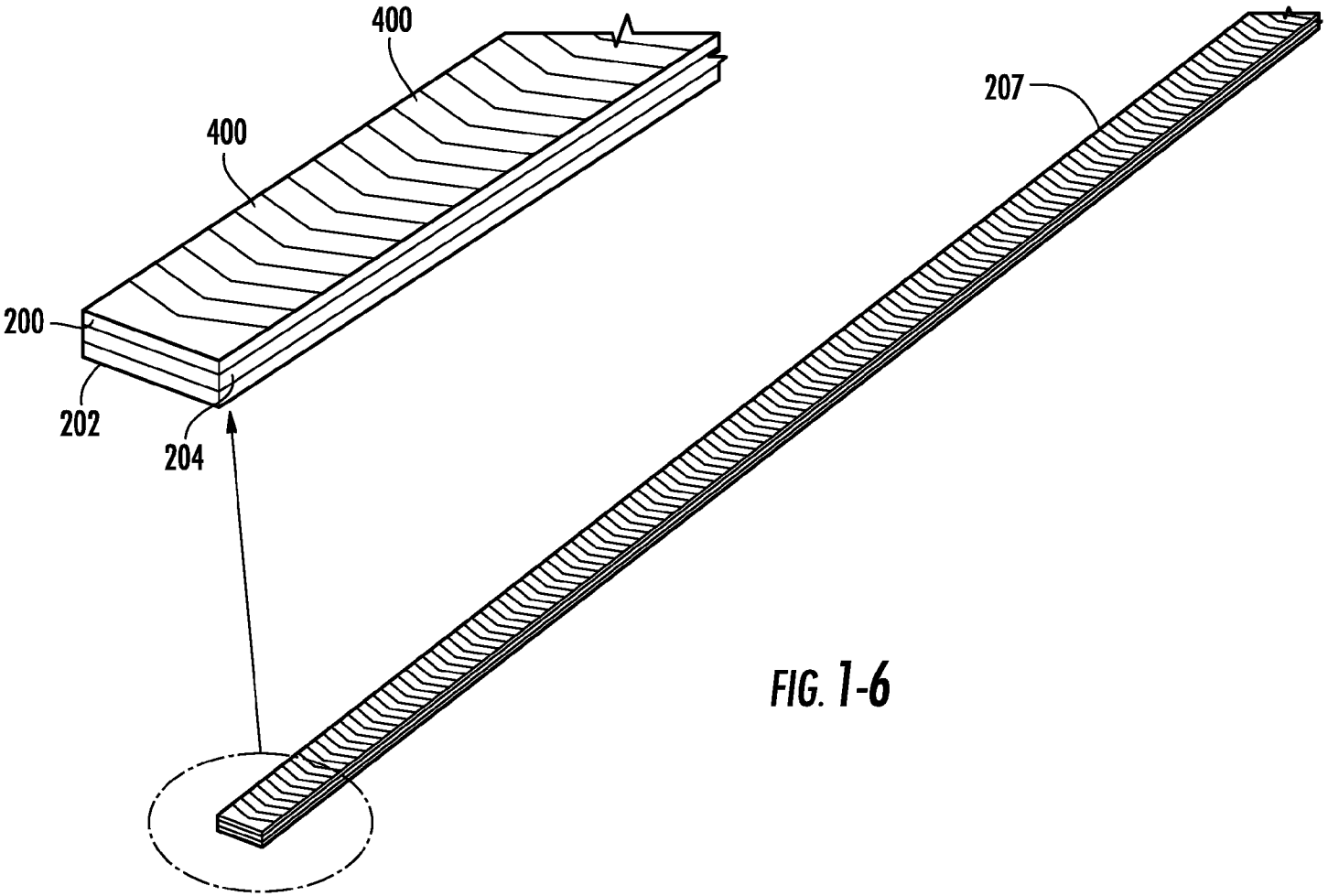

Also significantly, the feed end 260 of the slab 300 can take various forms shown in FIGS. 2-3 and 2-4, yielding a cost-effective electronically scanned array that can handle high power. The architecture provides the ability to steer a beam using a traveling wave fed structure in one dimension and using either an adaptable-delay power divider or traditional Transmit/Receive (T/R) modules to adjust the phase in the other dimension, to yield a 2D scan capability.

The FIG. 2-3 implementation uses a singe feed 2601 with an adaptable-delay power divider. The power divider is tapped 2602 along its length, and can be formed from a single or multiple layer element providing the required delay.

The FIG. 2-4 implementation uses multiple transceiver (T/R) modules 2610-1, 2610-2, . . . , **2610-*n* with a corresponding number of individual feeds 2611-1, . . . , 2611-*n***, that is, one T/R module and one feed per subarray.

These approaches have similar performance to that of other phased arrays, but with either an order of magnitude less complexity or if our adaptable-delay power divider is used, no modules.

For high power applications the multiple feed is likely preferable, while for SATCOM applications the single feed case may be more cost effective. Both approaches reduce the cost of the system when compared to a typical phased array of the same performance.

Scattering Feature (Element) Designs

There are a multitude of possible scattering element configurations that provide varying degrees of efficiency in the desired leaky mode of operation. Due to metal Ohmic heating losses and manufacturability at these sizes, it is desirable to use a dielectric groove or imprint structure. However, it is also possible to use metalized elements to capture the same effect, albeit with higher losses. The following figures show element shapes that have varying degrees of ellipticity, and/or high efficiency in a single polarization.

With all element cases, there remain two similarities. The element spacing distribution has an effect on the frequency of operation and bandwidth of the array. For each element type and bandwidth desired, the spacing of element to element is optimized. For most element types, there is a width distribution increasing along the long axis of the subarray, as mentioned above. The intention of this increasing width distribution is to couple and scatter a similar amount of energy from each element. To do this, the elements near the excitation end 260 (or feed) are narrower, so they do not scatter as much energy per unit area as the elements further down the long axis. The width distribution is adapted for example, from Rodenbeck, Christopher T., "A novel millimeter-wave beam-steering technique using a dielectric-image-line-fed grating film", Texas A & M University, 2001, at equation 3. This width relationship is optimized for each element type to maximize array radiation efficiency.

FIGS. 3-1 though 3-15 depict various scattering element shapes for both the one-dimensional rod and array (slab) configurations.

FIG. 3-1 is a single rectangular dielectric rod waveguide 160 with surface rectangular grooves 150 that provide single polarization.

FIG. 3-2 is another embodiment with a dielectric rod waveguide 100 with surface features shaped as triangular grooves 151.

FIG. 3-3 illustrates metal strips 501 disposed on the surface of the dielectric rod 100. The strips are shaped in a cross configuration, and are preferably offset from a centerline of the rod. This arrangement provide co-located features to achieve V polarization (V-pol) and H polarization (H-pol).

FIG. 3-4 illustrates dielectric grooves 502 in a cross configuration also providing collocated V and H polarization response.

FIG. 3-5 shows an implementation that increases the H-pol efficiency (and hence improving the axial ratio) by asymmetrically grooving the H portion 570 of the element deeper into the waveguide, which also increases the coupling for the H-pol portion.

FIG. 3-6 separates the V-pol and H-pol 580, 581 grooves along the waveguide 200 surface, which further increases radiation efficiency from each scattering element because it minimizes cross coupling between adjacent pairs.

FIG. 3-7 shows vertically separate V- and H-pol elements 590, 591, which can provide increased efficiency over collocated "crosses". While the V- and H-pol elements are not technically collocated here, separating these vertically allows the V- and H-pol elements to use the same surface area.

FIG. 3-8 is an implementation using triangular grooves that can be combined and collocated for two adjacent multi-polarized line arrays in a single subarray. Note that the width of the grooves 600 changes with position along the subarray.

FIG. 3-9 is an implementation where the scattering features obtain circular polarization with interleaved metal strips 610.

FIG. 3-10 implements metal strips imprinted as dielectric triangular or rectangular grooves 620, 621 to provide V and H-pol response.

FIG. 3-11 rotates the orientation of the triangular or rectangular grooves 630 to provide a mixed V and H pol response.

FIG. 3-12 has scattering features implemented as raised triangle structures 640 to provide a single polarization response.

FIG. 3-13 is a similar implementation using raised right angle trapezoid structures 641 to also provide a single polarization response.

FIG. 3-14 shows raised interleaved crosses 650 to provide V- and H-pol response.

FIG. 3-15 is an implementation with offset longitudinal slots 670, 671 providing H-pol response along the long axis.

It should be understood that surface features resulting in other types of array polarizations (such as Left/Right Hand Circular Polariation (L/RHCP) can also be utilized.

Correction Wedge

A significant challenge is the instantaneous bandwidth of the array. Equation (1) indicates that there is a shift in the beam direction as the frequency changes. This distortion is caused by the fact that all usable beams are higher order beams.

FIG. 4 *shows* a one-dimensional (1-D) subarray 305 configuration with surface scattering features similar to that of FIGS. 1-3 and/or FIG. 1-7. The surface scattering features decrease in size with position from the resistive load end 250 to the excitation end 260.

The approach to correcting frequency distortion introduced by this geometry is to situate a correcting layer 700 on top of the subarray 305. This layer, shown in FIG. 4, permits the use of the principal m=0 order.

The idea behind the correction layer 700 is to linearly add increasing delay to the scattering elements from the resistive load 250 to the excitation end 260. Incident radiation enters along the top surface of the correction layer 700 and is delayed depending upon the location of incidence. When this is done properly, the quiescent delay for each element of the subarray across the top plane of the correction layer 700 is therefore the same, regardless of the position along the subarray at which the energy was received (or transmitted). The effect is that in the far-field, the beams over frequency line up at the same point.

One implementation that has been modeled indicates a $TiO_2$ top wedge layer 700, and a lower dielectric $SiO_2$ waveguide 100. Forming the correction wedge of a higher dielectric permits it to be "shorter" in height". There are a multitude of materials that can be used to implement the correction wedge 700. The propagation constant of the waveguide should also be constant as a function of frequency, which is achieved by operating in the constant propagation regions of the waveguide as was shown in FIG. 1-4 (the waveguide dispersion curves).

Linear delay can be implemented in other ways. For a multiple rod implementation, depositing a set of wedges, such as a wedge 700 for each 1-D array would be tedious. Instead, one can fabricate a molded plastic sheet with a series of wedges. In other implementations, a $TiO_2$ layer with top facing groves can replace the wedge to re-radiate the energy incident on the scattering elements as per FIG. 6. A coupling layer with a tapered shape but constant dielectric may be disposed between the $TiO_2$ and $SiO_2$ layers.

Since the wedge of FIG. 4 may introduce unwanted dispersion along the array, it may be necessary to compensate. It is possible to insert a low dielectric constant gap 782 (FIG. 5) between the wedge 700 and the dielectric waveguide 200. This gap 782 allows the waveguide to guide the wave while not affecting the propagation constant. The wedge 700 sitting above this gap still retain its delay characteristics for each element of the 1-D array.

Chirped Bragg Layers to Provide Broadband Operation

Chirped Bragg layers situated underneath the waveguide structure can alter the propagation constant of the waveguide as a function of frequency. In this way, it is possible to line up beams in the far-field, making this antenna broadband.

Figures 1, 2, 3, 4, 5, 6, 7:
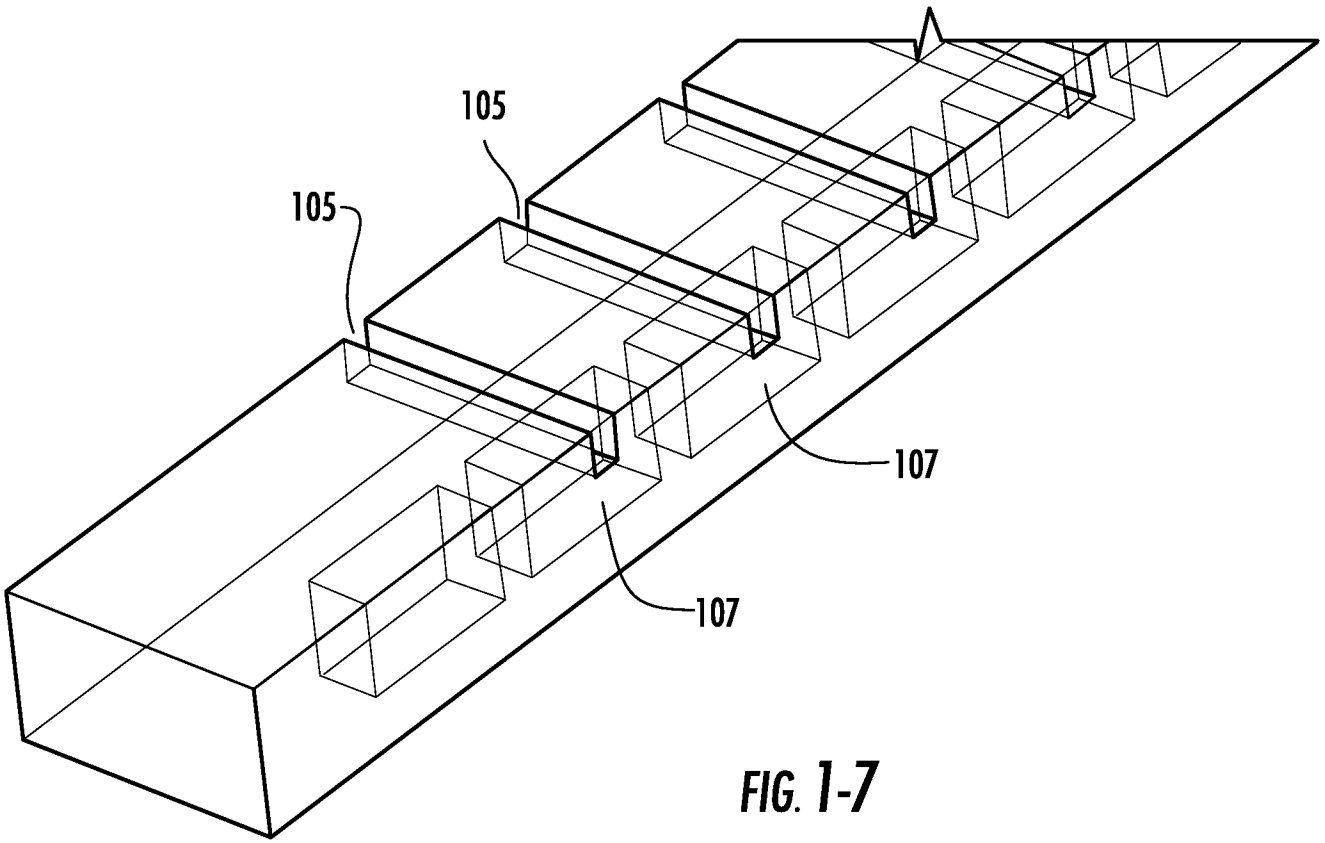

An embodiment of an apparatus using such Frequency Selective Surfaces (FSS) 1011 shown in FIG. 7. These FSS 1011, also known as chirped Bragg layers, are provided by a set of fixed layers of low dielectric constant material 1012 alternated with high dielectric constant material 1010. The spacing of the layers is such that the energy is reflected where the spacing is ¼ wavelength. The relatively higher frequencies (lower wavelengths) are reflected at layers P1 (those nearer the top surface of waveguide 100) and the lower frequencies (high wavelengths) at layers P2 (those nearer the bottom surface). The local (or specific) layer spacing as function of distance along P1 to P2 is adjusted to obtain the required propagation constant as a function of frequency to achieve wideband frequency independent beams. Equation (1) can be solved for a given beam direction to obtain the geometry of the chirped Bragg layers.

Figures 1, 2, 3, 4, 5, 6, 7, 8:
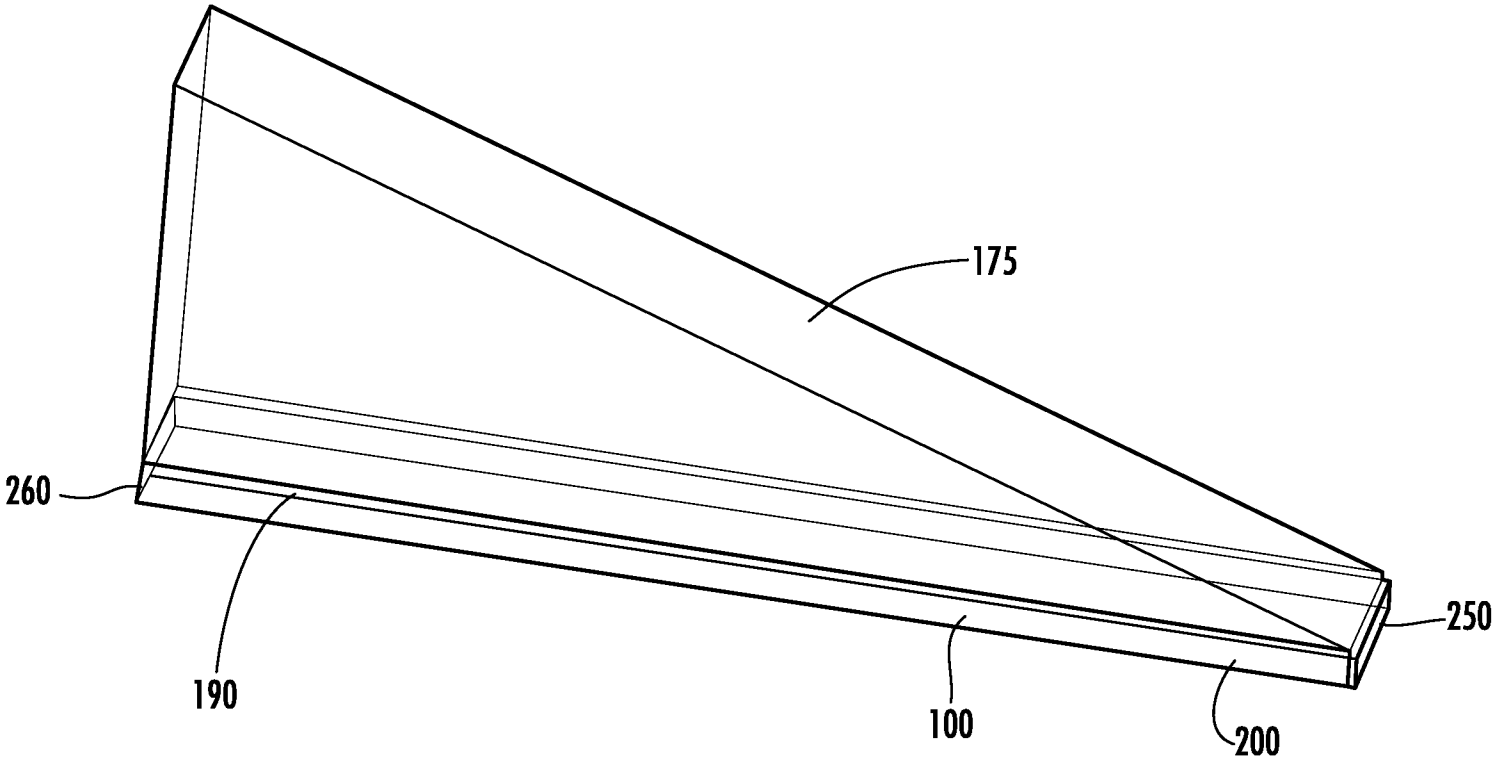
Figures 1, 2:
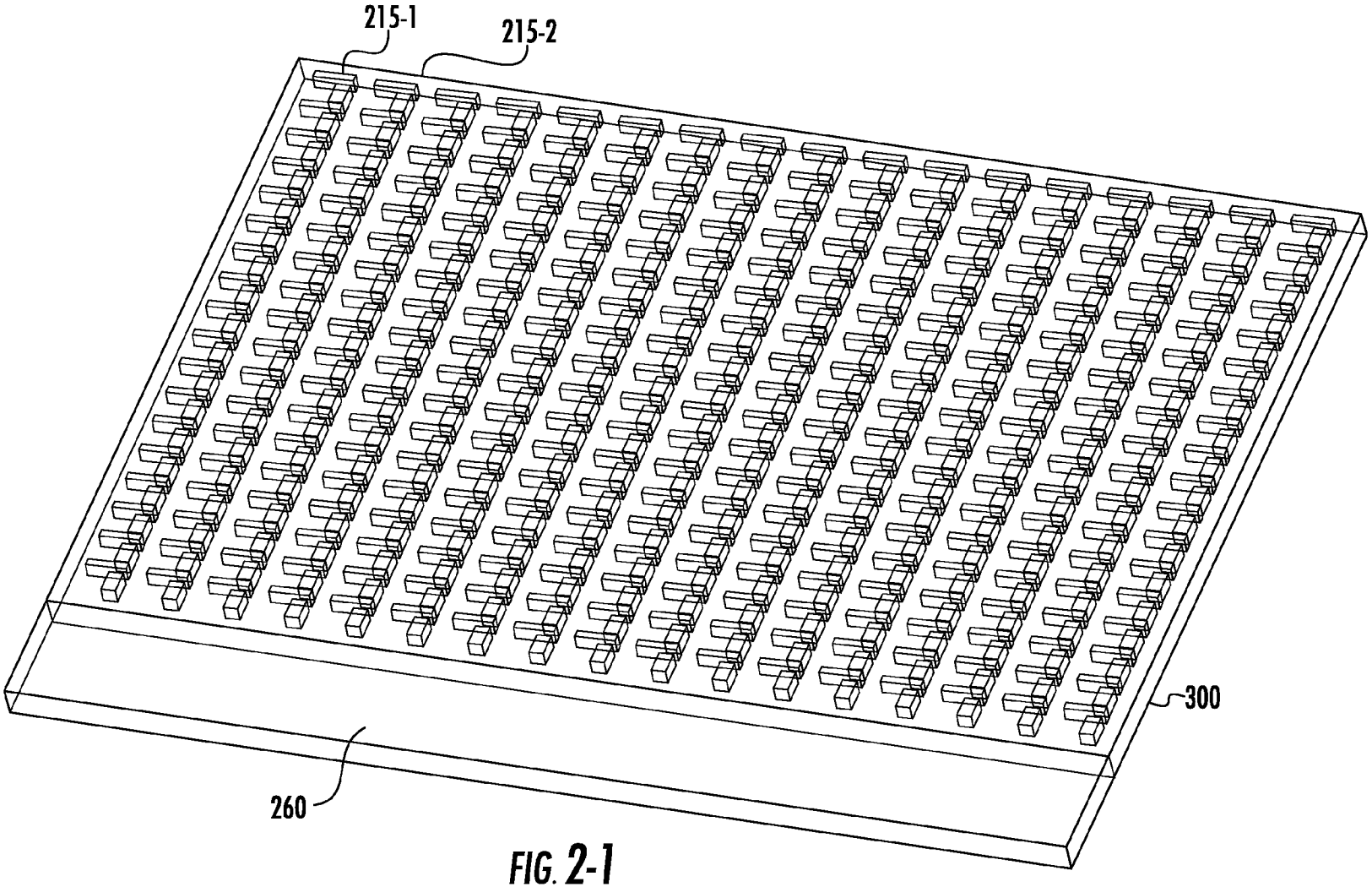
Figure 2:
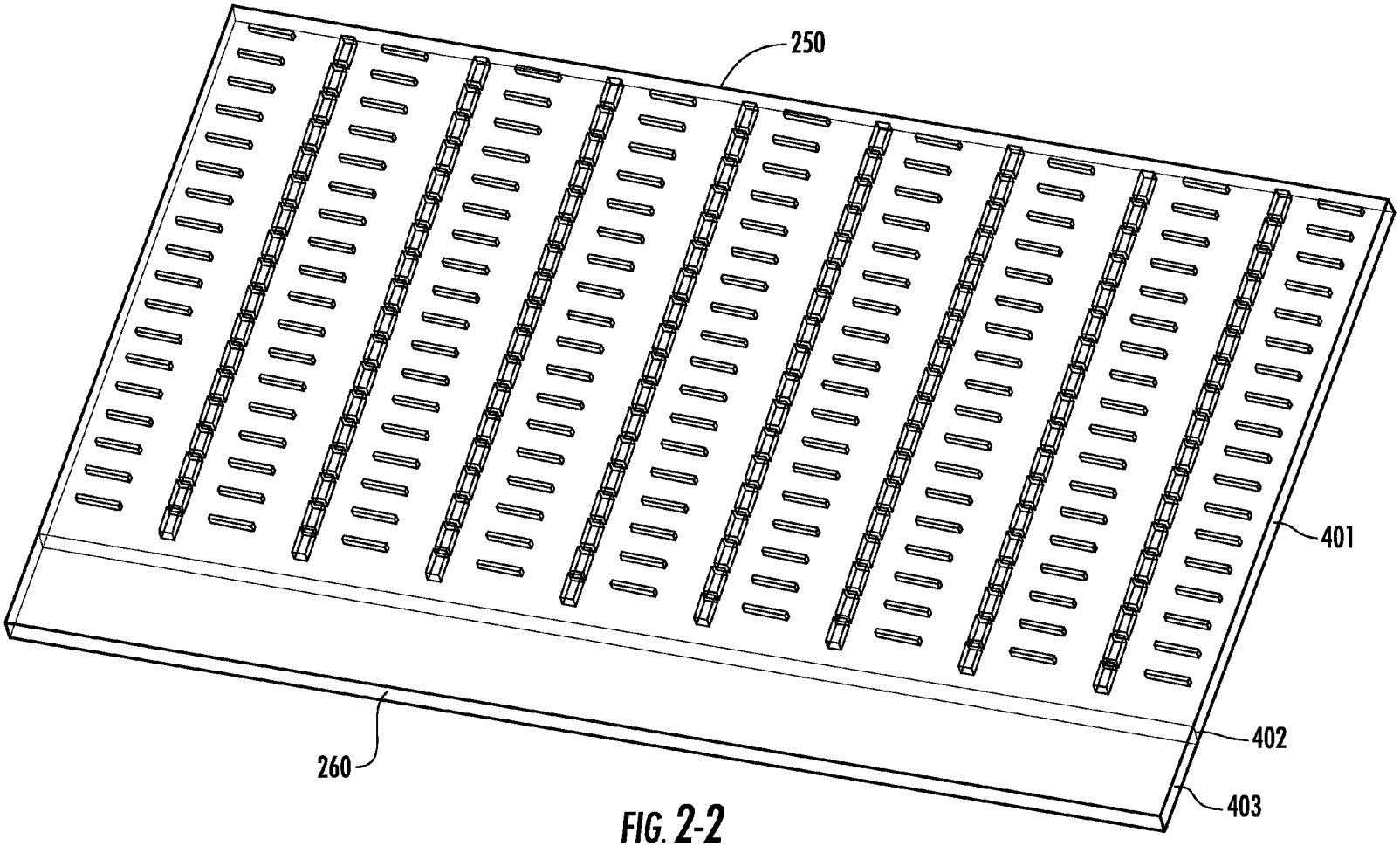
Figures 2, 3:
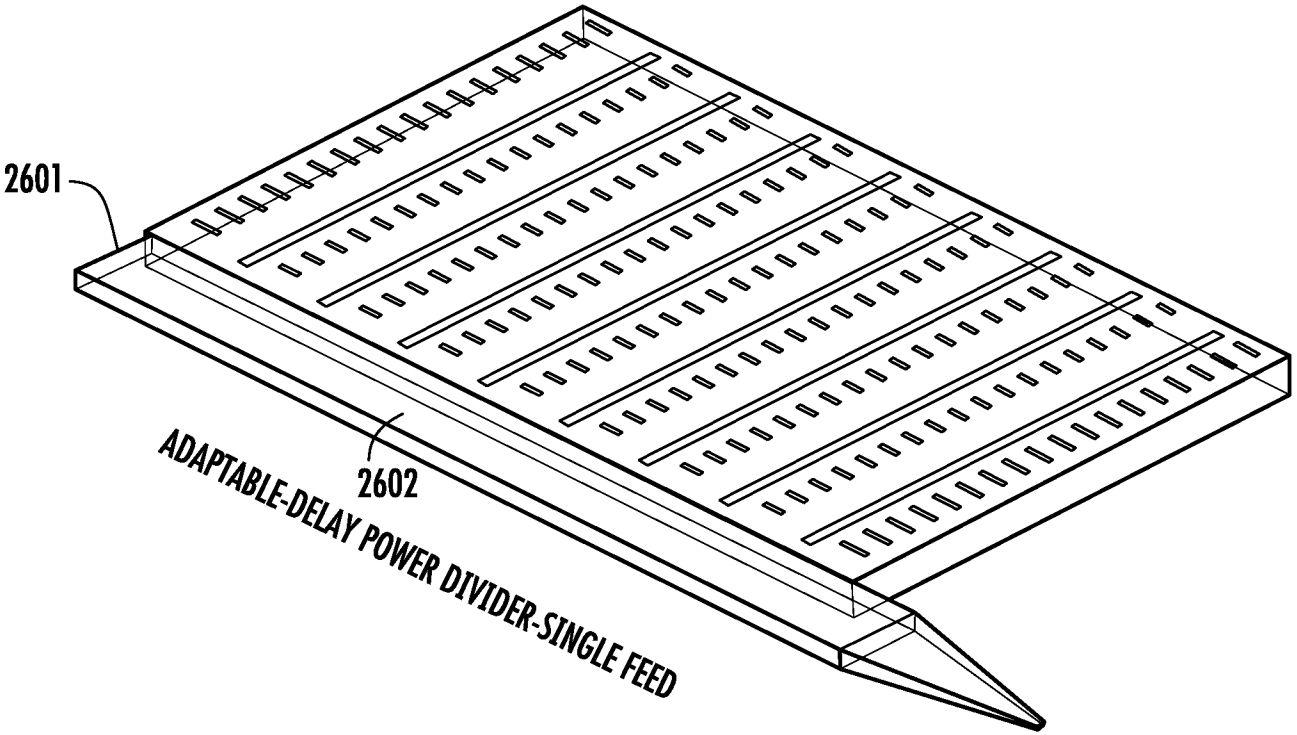
Figures 2, 3, 4:
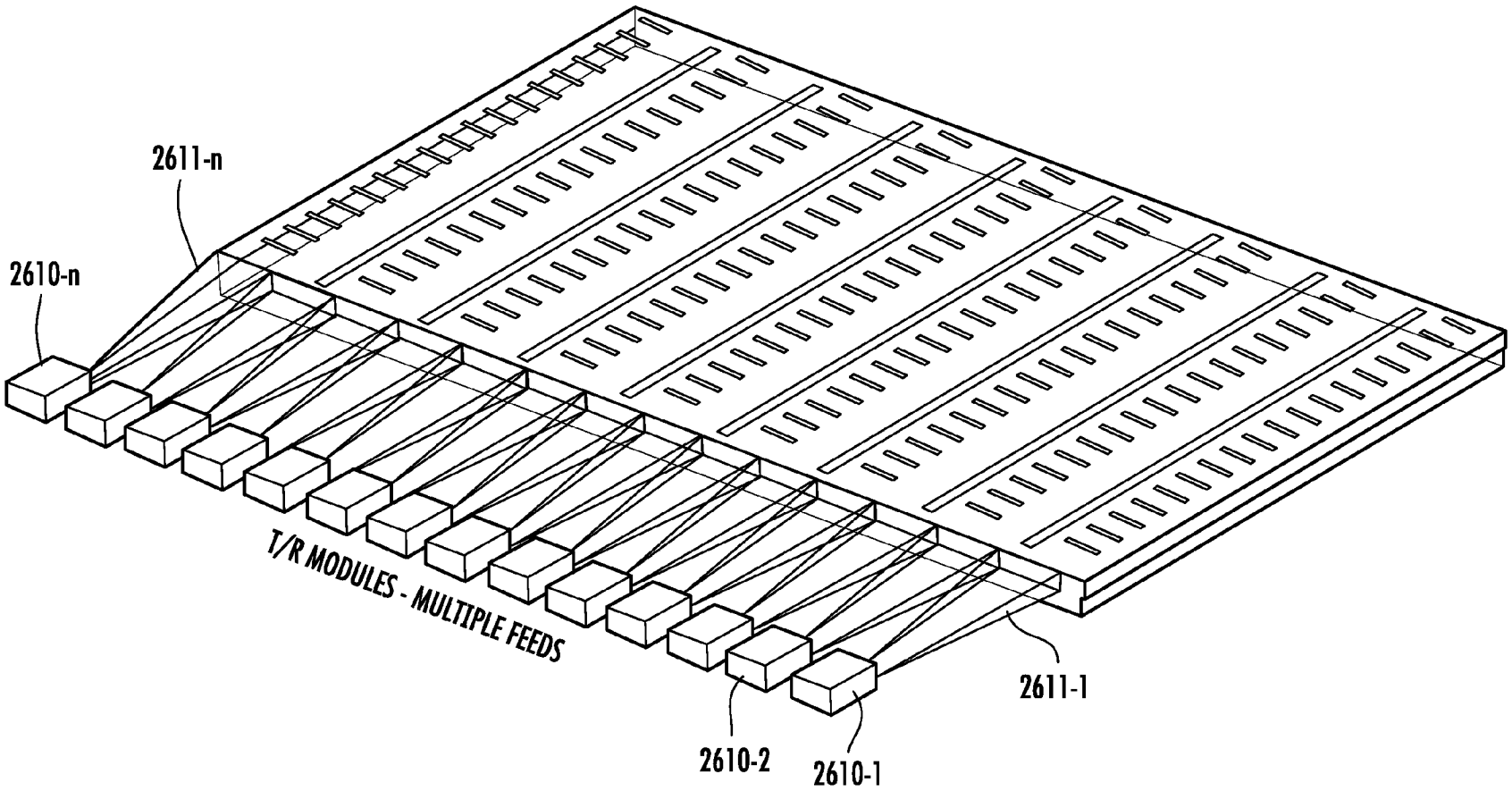

FIG. 8 is a depiction of the waveguide 200 with multiple chirped Bragg layers 1010, 1012 located beneath a primary, non-Bragg waveguide layer 1030. This example (the illustrated Bragg layers are not to scale) was modeled using alternating layers made up of SiO2 and TiO2; however any material(s) with differing dielectric constants could be used in these layers.

Spacing of the Bragg layers 1010, 1012 can be determined as follows. An equation governing the beam angle of a traveling wave fed linear array is:

$$\cos(\text{theta}) = \text{beta(waveguide)}/\text{beta(air)} + \text{lambda/element spacing}$$

where beta (waveguide) is the propagation constant of the guide.

To eliminate the frequency dependency of theta, we solve the equation for beta (waveguide). The required frequency dependency of beta can be fashioned by controlling the effective thickness of the waveguide as a function of frequency derived by using the general dispersion curve of the waveguide itself.

The effective thickness as a function of frequency is then provided by a series of chirped Bragg layers as shown in FIG. 8 forming the waveguide. Each layer is composed of two sub layers of a high dielectric and a low dielectric. Each sub layer is preferably ¼ wavelength thick at the frequency at which energy is reflected in that layer. The layers get progressively thicker such that the lower frequencies reflect at the thicker layers. The methodology of determining the geometry of the layered structure is a recursion relation involving creation of the above layers starting at the top layer (L=1), the reflecting layer at the highest frequency f(1). The next layer (L=2) is determined by the relation T(f(L))−T(f(L−1))=k/f(L) where k is the average velocity in the structure, and L is the layer number. The next adjacent layer follows this recursive relationship, and so forth.

Beamwidth Control

Figures 1, 3:
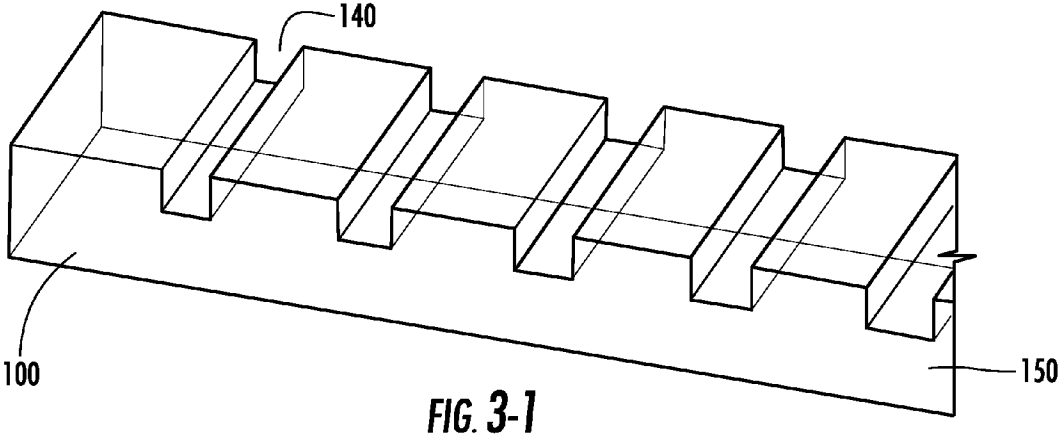
Figures 2, 3:
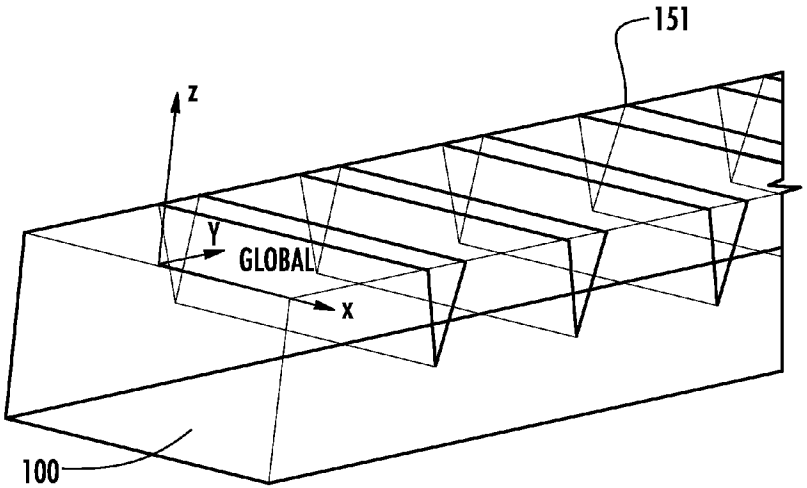
Figure 3:
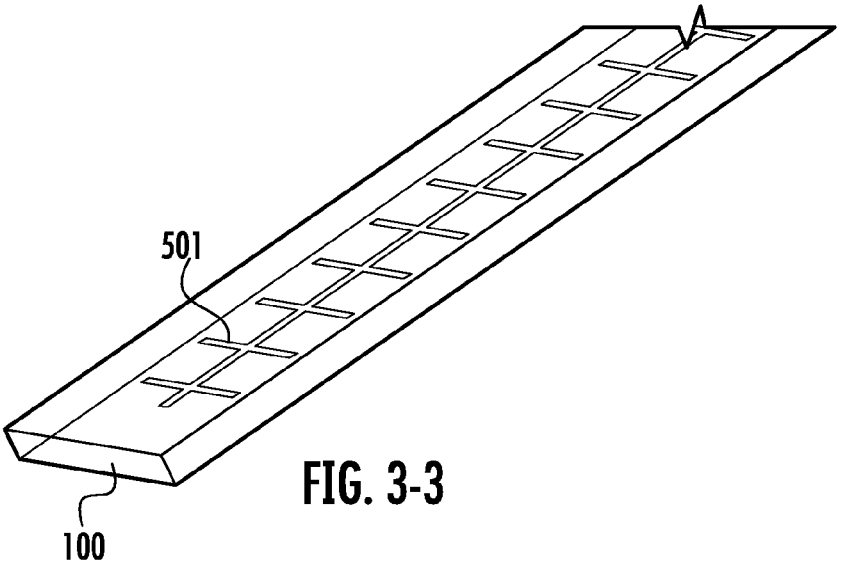
Figures 3, 4:
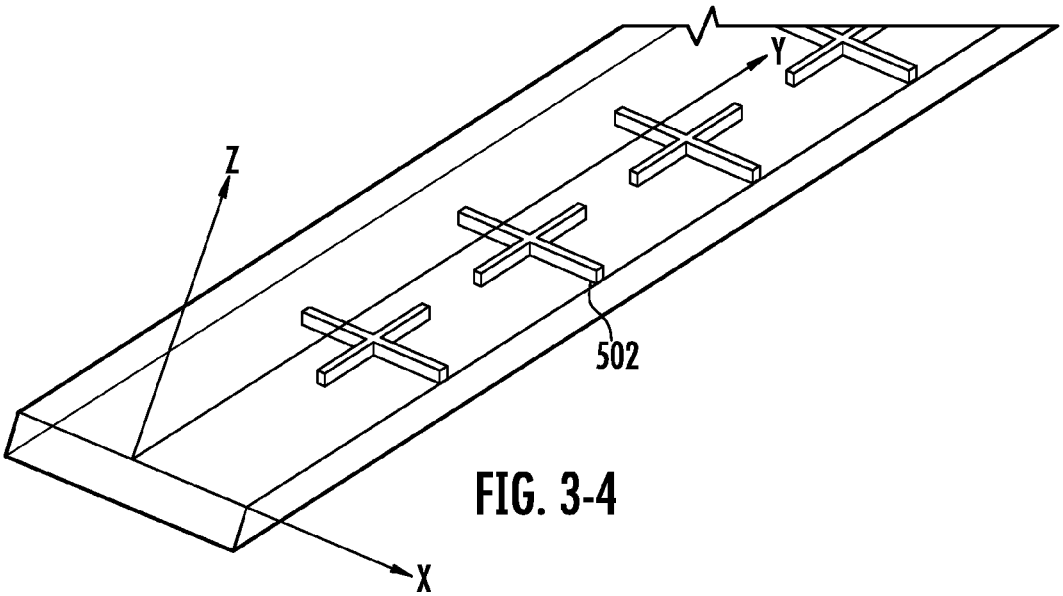
Figures 3, 4, 5:
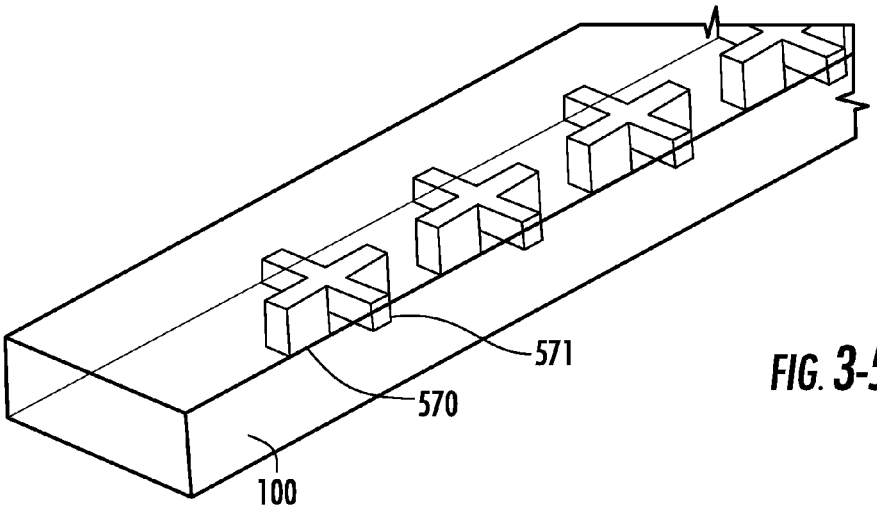
Figures 3, 4, 5, 6:
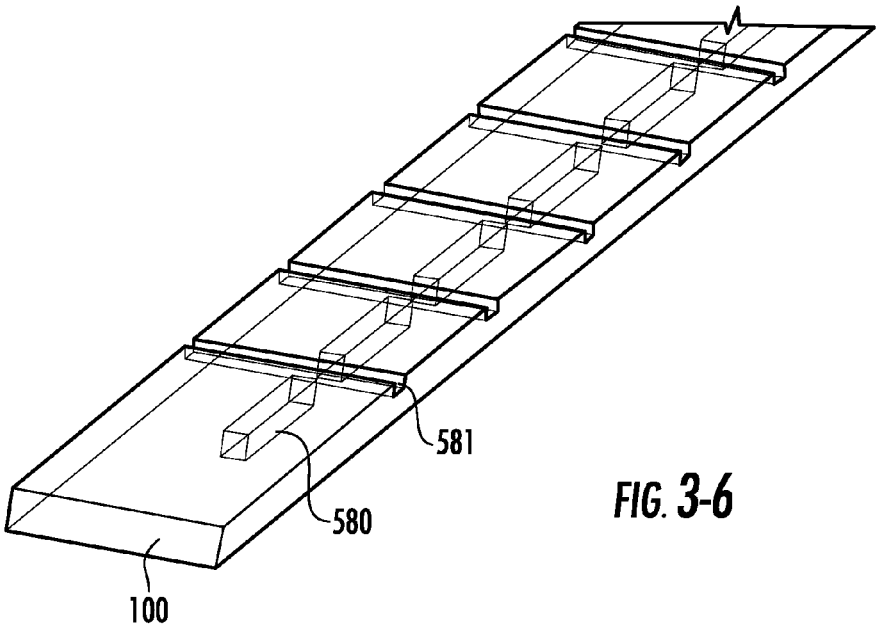
Figures 3, 4, 5, 6, 7:
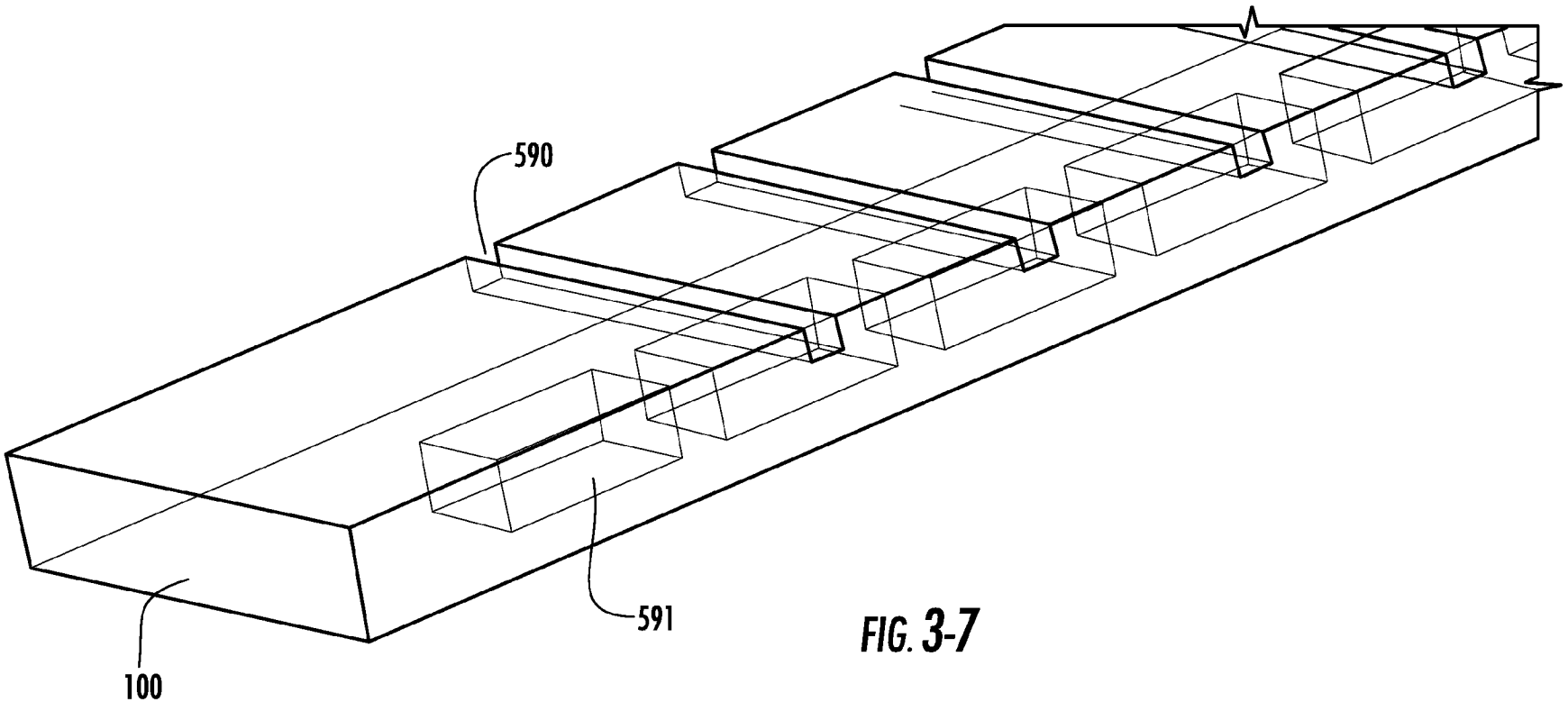
Figures 3, 4, 5, 6, 7, 8:
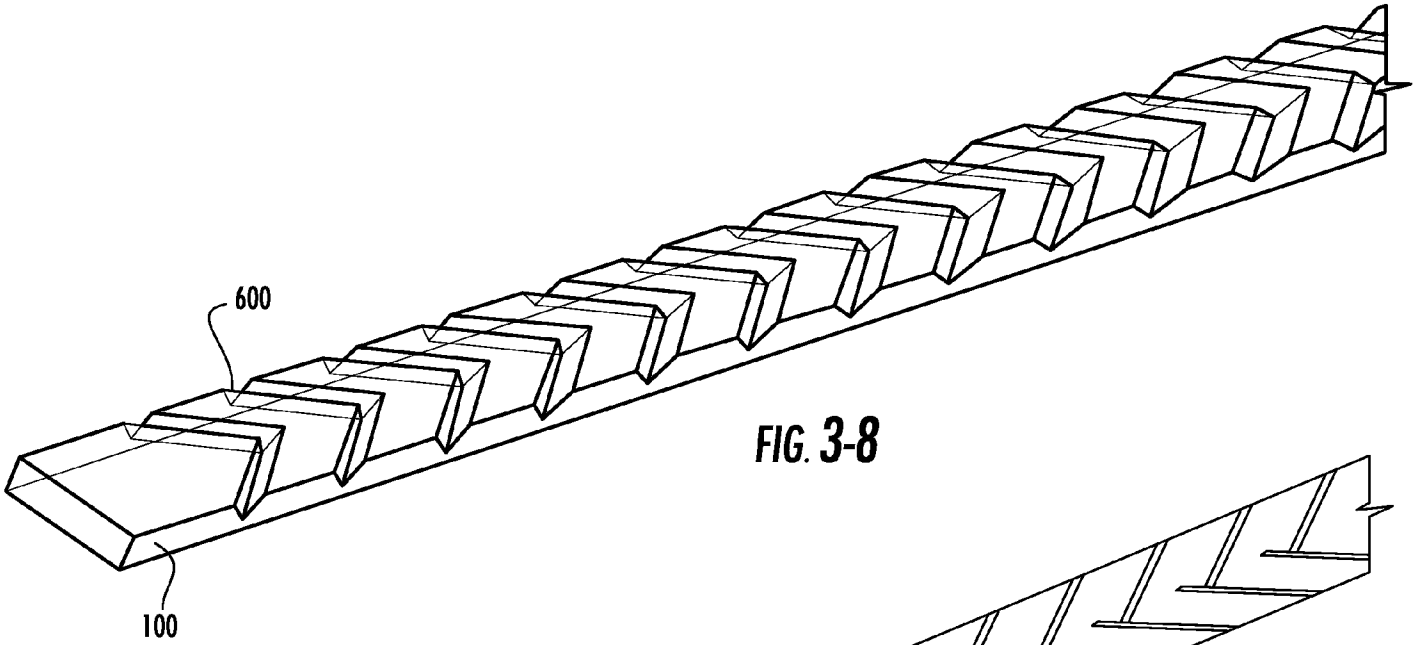
Figures 3, 4, 5, 6, 7, 8, 9:
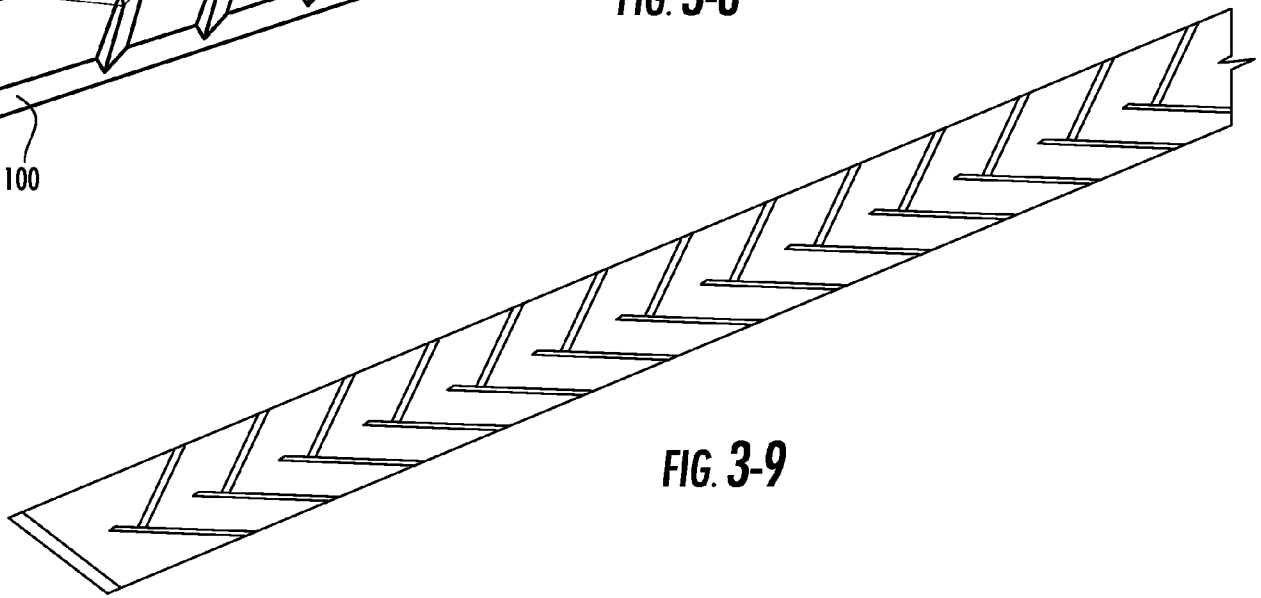
Figures 3, 4, 5, 6, 7, 8, 9, 10:
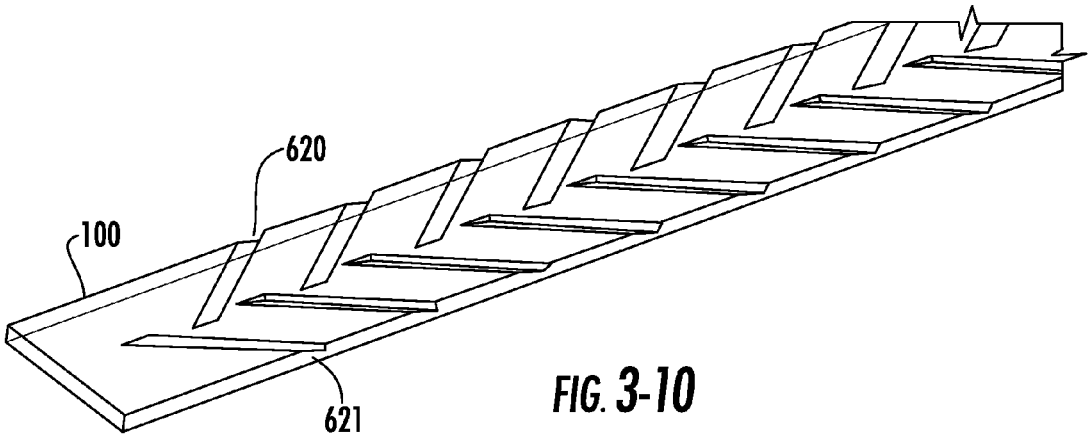

To further assist with controlling a beamwidth, quadratic phase weights may be added. This can be done by implementing a quadratic phase weighting along the primary axis of a 1-D array, and can be achieved with either 1) gradually tapering a dielectric layer 1050 (as shown in FIG. 9) that is located adjacent the scattering elements 400 or 2) a sub-surface array of elements 1055 with quadratic length taper along the array axis (FIG. 10).

The sub-surface elements within the waveguide can be varied in length, spacing, and or depth within the waveguide to obtain the desired quadratic phase weighting. Regardless, the sub surface elements are located deep enough within the waveguide so as to not radiate outside the waveguide. The weighting layer be defined by $$\phi(x)=e^{i\alpha x^2}$$

where x is the distance along the waveguide and a is a weighting constant.

Scanning and Steering

The high gain fan beams of the 1D subarrays can be steered in order to track a desired transmitter or receiver. This steering can be achieved in two ways: mechanical and electrically. The 1D tracking requirement facilitates either mechanical or electrical tracking methodologies.

Mechanical

In this approach, the leaky wave mode antenna is placed on a support that is mechanically positioned utilizing a positioner or some other mechanical means such as MEMs or electro active devices.

Electrical

Figures 3, 4, 5, 6, 7, 8, 9, 10, 11:
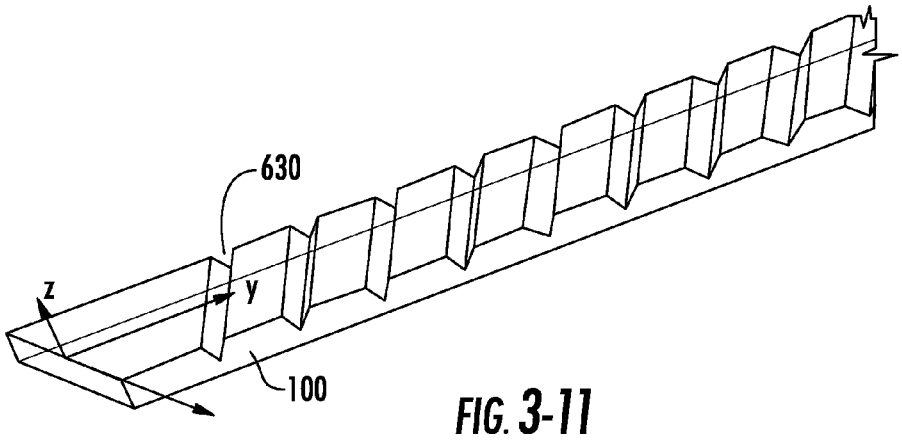

In this approach, the system electrically scans the main beam by dynamically changing the volume or spacing of gaps 1022 in the dielectric waveguide. It is equivalent to changing the "effective dielectric constant," causing more or less delay through the waveguide. The fields associated with the HE11 mode (the mode operating in the rod type waveguide) are counter propagating waves traversing across the gaps 1077 as shown in FIG. 11. The effective dielectric constant change is independent of frequency as long as the gap spacing, s, is less than ¼ wavelength.

The fields associated with the HE11 mode are counter propagating waves traversing across the gaps 1077. The propagation constant of the rod is increased by the factor K=sqrt[(1+w)/(1−w)] for small dielectric spacing w, which is equivalent to an increase in the rod's effective dielectric constant. The increase is independent of frequency as long the as the gap spacing, s, is less than ¼ wavelength. The idea is to control the gap size by using piezoelectric or electro-active actuator control elements to effect a change in the propagation constant of the rod.

Electrical scanning can be achieved by controlling the gap size by with piezoelectric, electro active, or any other suitable control element that is fast acting to effect a change in the propagation constant of the waveguide. The wedge configurations of FIGS. 4 and 5 are readily amenable to incorporation of the gaps 1077 in the waveguide.

Figures 3, 4, 5, 6, 7, 8, 9, 10, 11, 12:
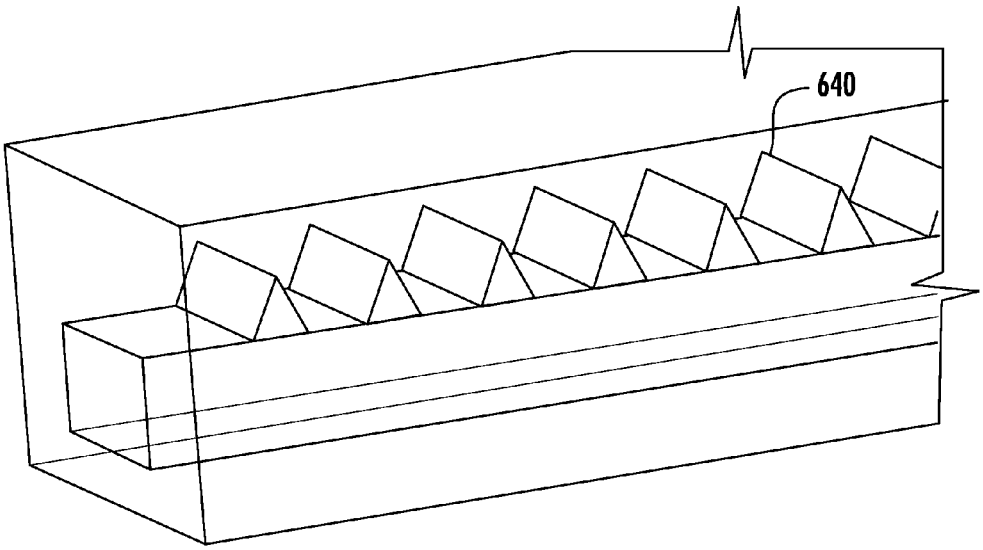
Figures 3, 4, 5, 6, 7, 8, 9, 10, 11, 12, 13:
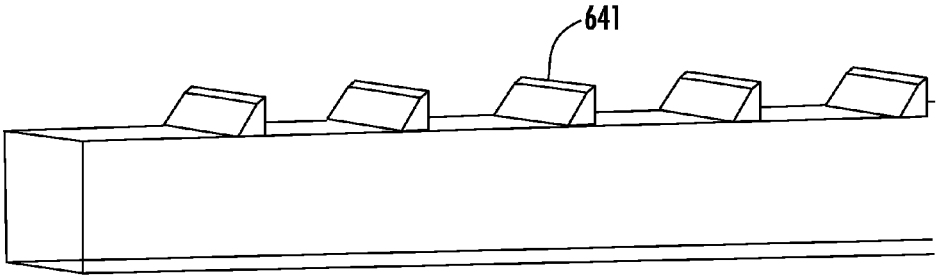
Figures 3, 4, 5, 6, 7, 8, 9, 10, 11, 12, 13, 14:
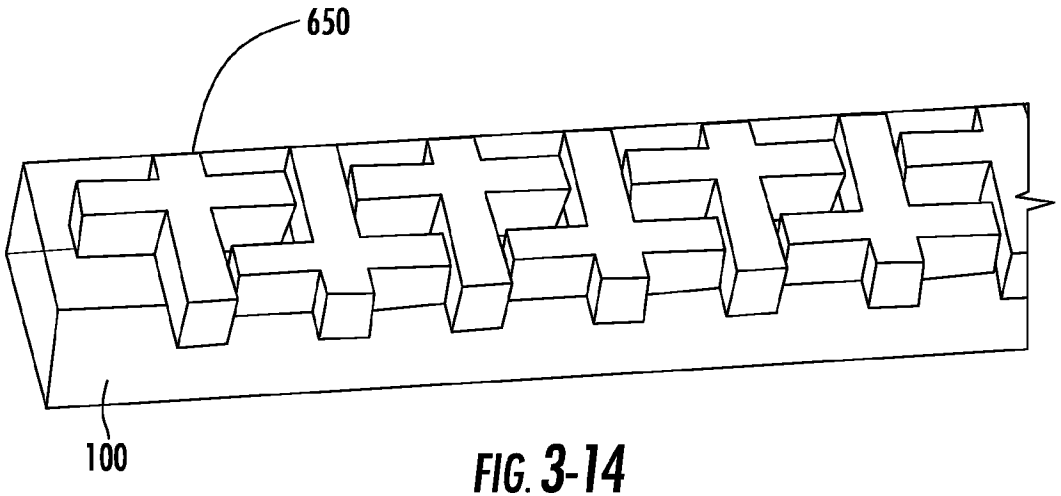

To achieve wideband propagation constant control, an additional chirped Bragg structure can be provided to adjust the effective rod diameter as a function of frequency. FIG. 12 shows this additional feature, chirped Bragg frequency selective surfaces (FSS) 1011, added to the structure of FIG. 11.

The FSS 1011 are fixed layers of low dielectric constant material alternated with high dielectric constant material. The spacing of the layers is such that the energy is reflected where the spacing is ¼ wavelength. The higher frequencies are reflected by the layer at position P1 and the lower frequencies by the layer at position P2. The local (or specific) spacing as functions of distance along P1 to P2 is adjusted to affect a wide band equalized propagation constant value. The dispersion curve of FIG. 1-4 evolves into the curve of FIG. 14, where $D_{eff}$ is the effective rod 100 diameter controlled by the configurable gaps. A further refinement of the curve in FIG. 14 insures that the beam direction is independent of frequency. These changes are found by solving equation (2) for each FSS layer and will result in a slight tilt in the curves of FIG. 14.

As an added degree of freedom, enhancing the Bragg FSS structure with reconfigurable Chirp dielectric layers 1079 (FIG. 13) provides better beam steering precision and efficiency. By chirping the structure, the wideband properties of the FSS Bragg layers takes effect, allowing frequency independent beams. With this approach, the reconfigurable structure and Bragg FSS are one in the same.

Figures 3, 4, 5, 6, 7, 8, 9, 10, 11, 12, 13, 14, 15:
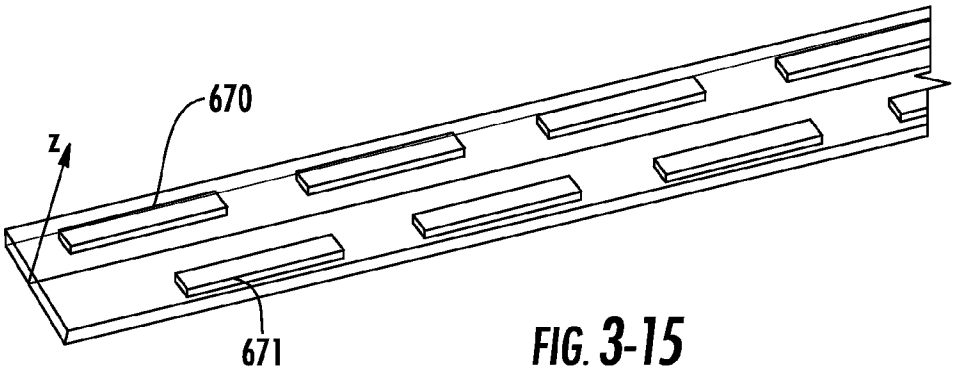
Figure 4:
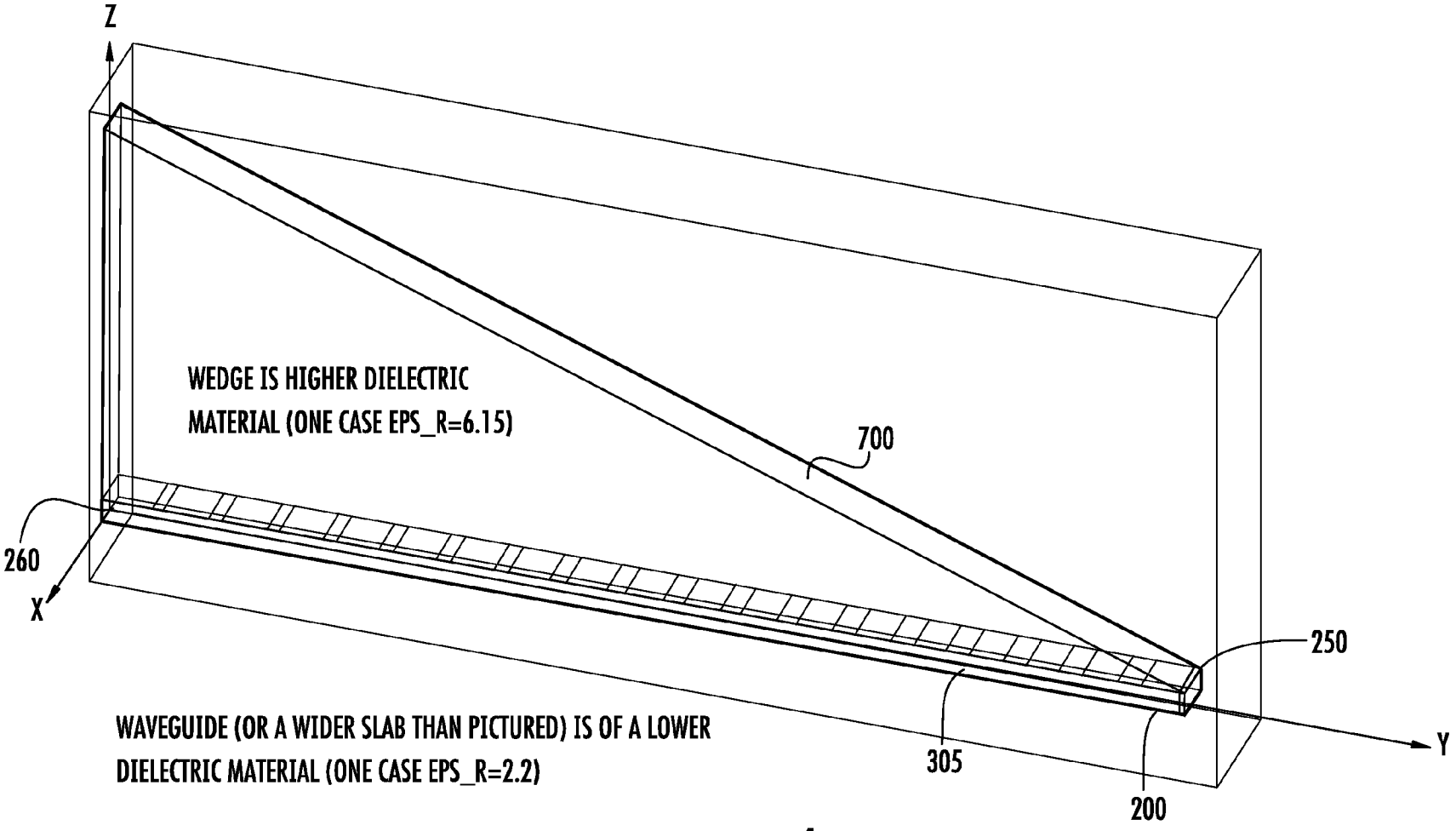
Figure 5:
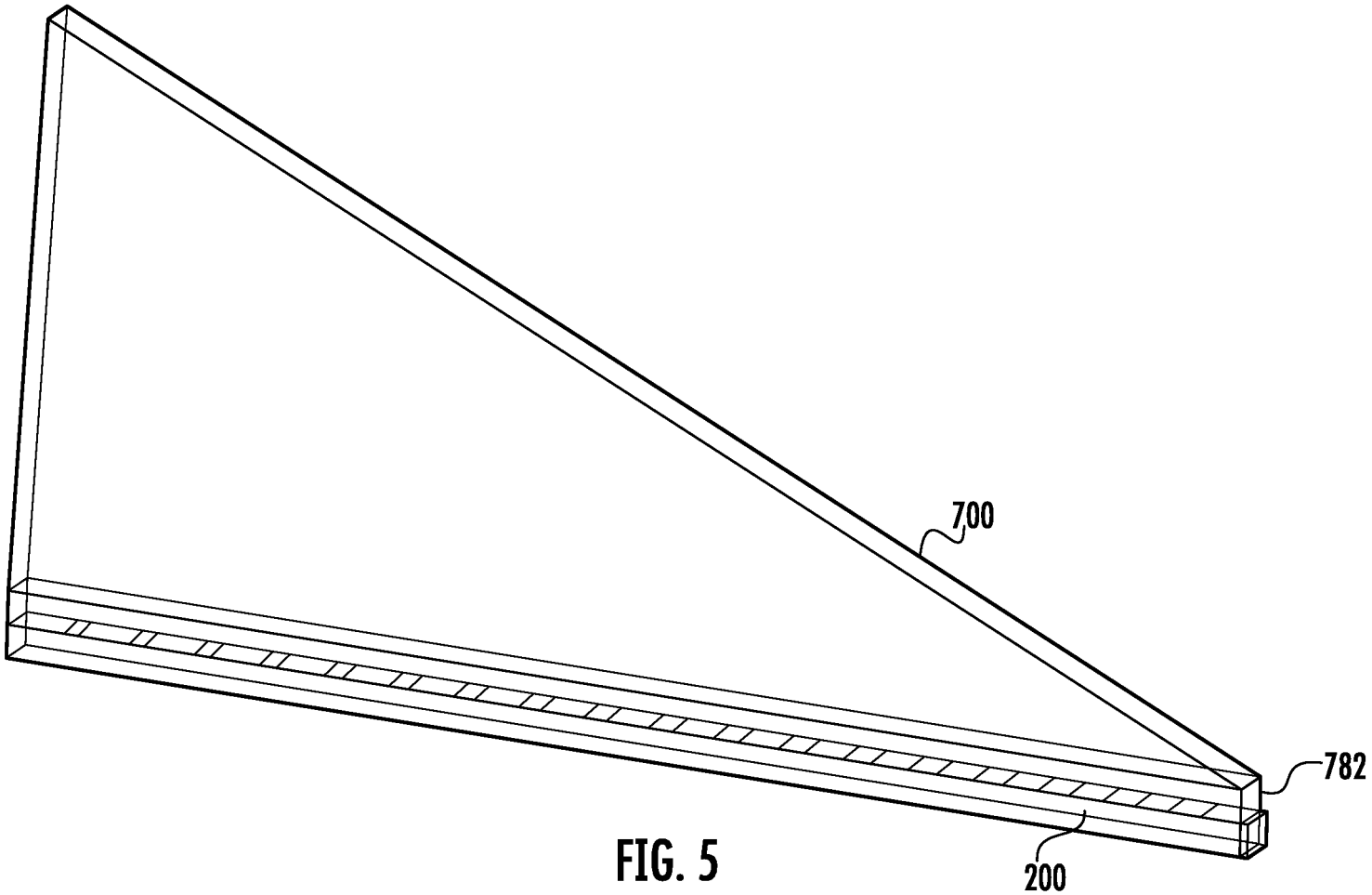
Figure 6:
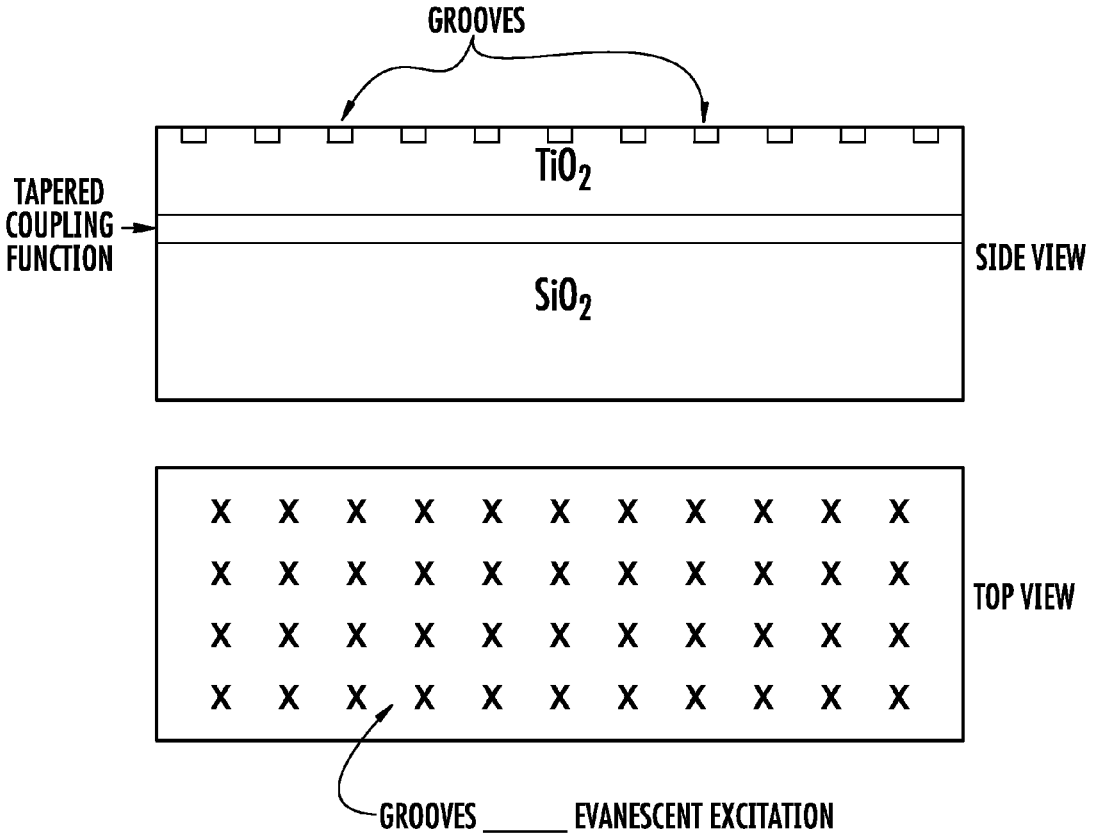
Figure 7:
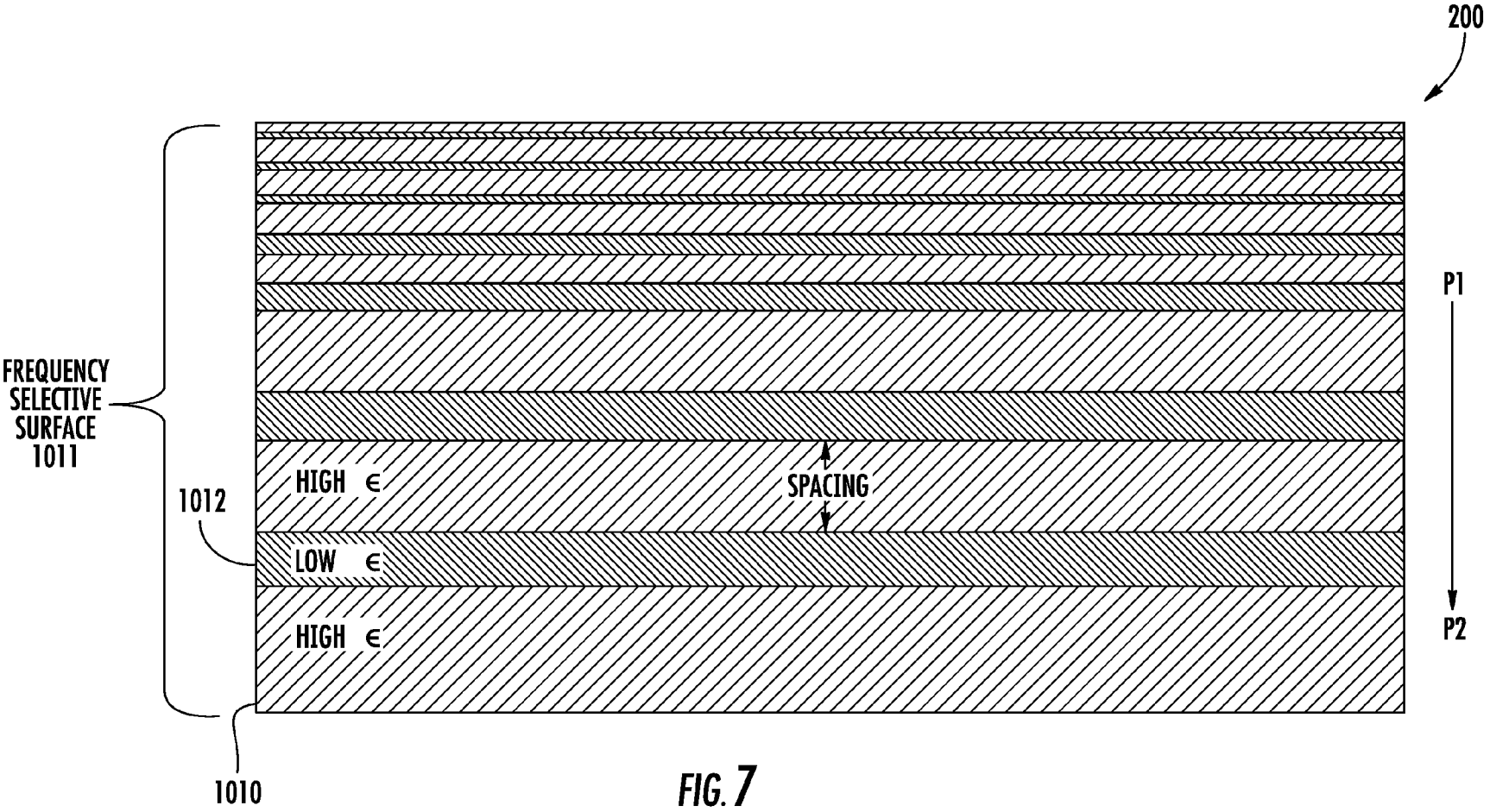
Figure 8:
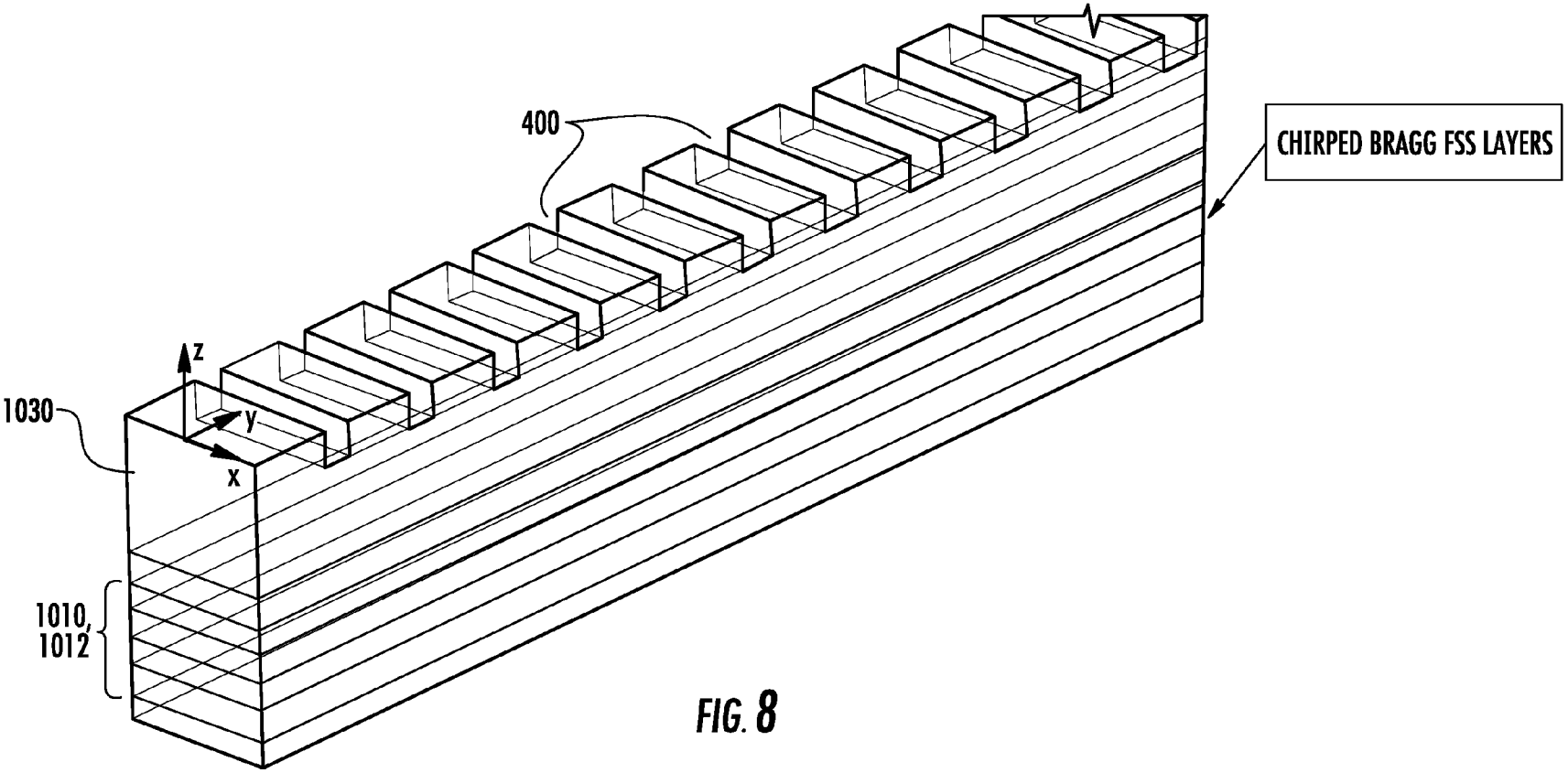
Figure 9:
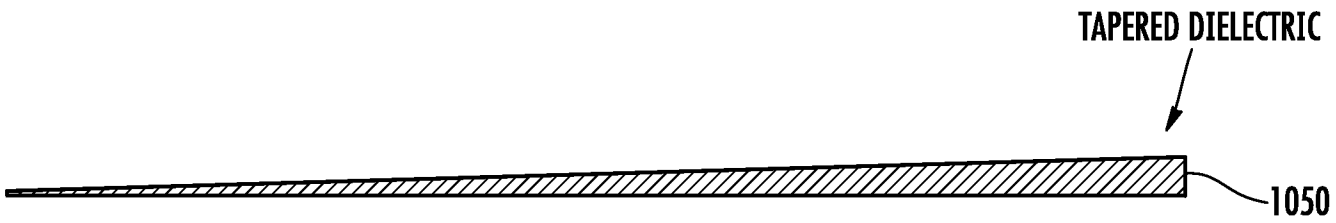
Figure 10:
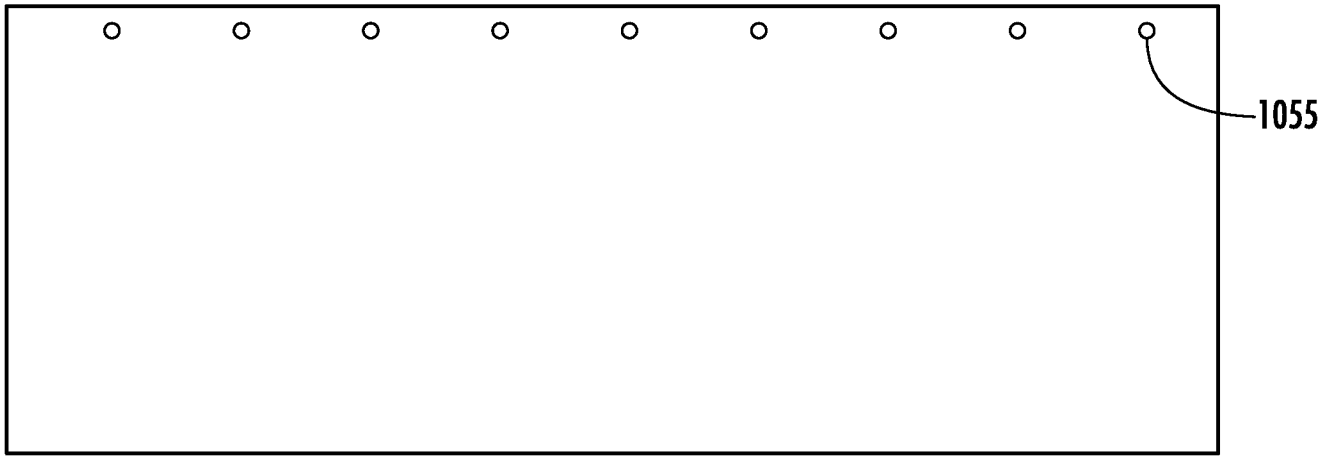
Figure 11:
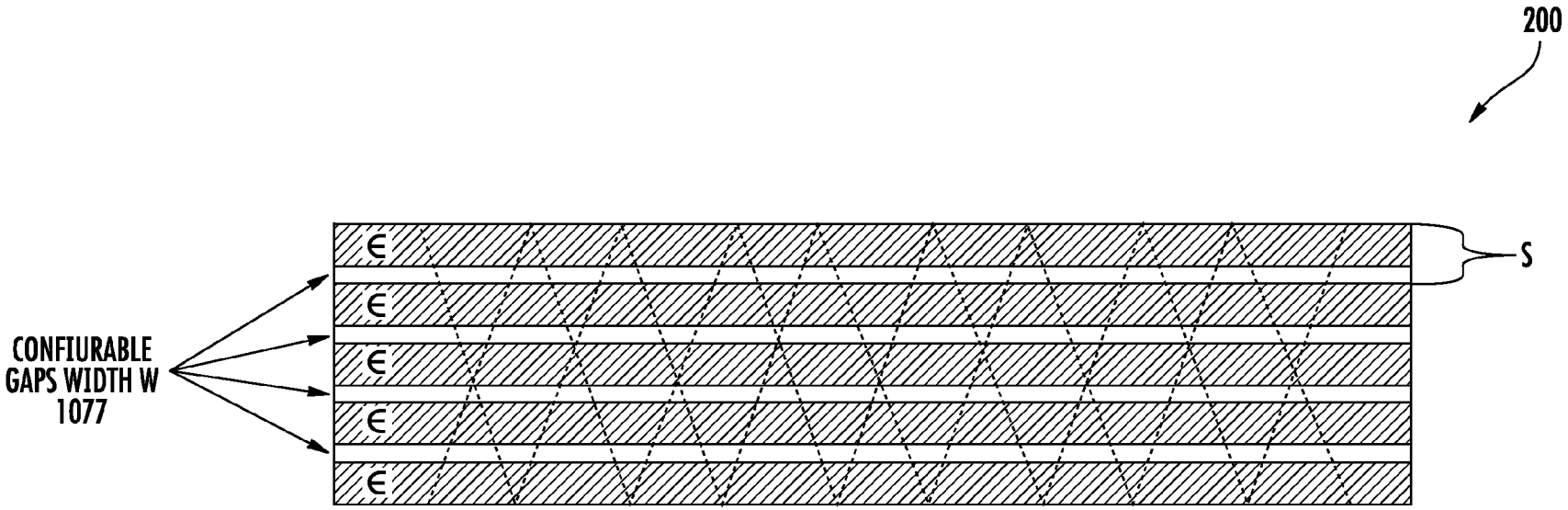
Figure 12:
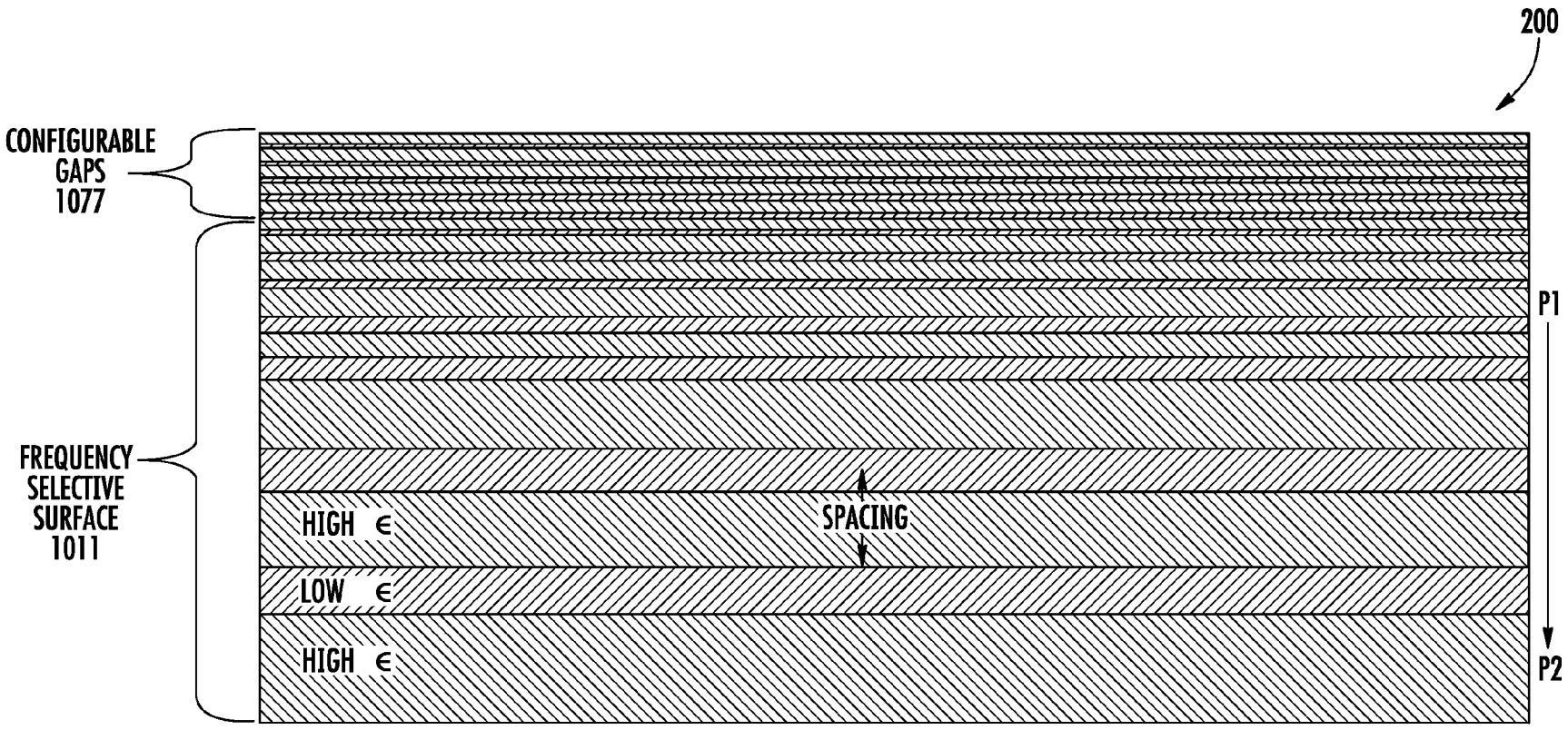
Figure 13:
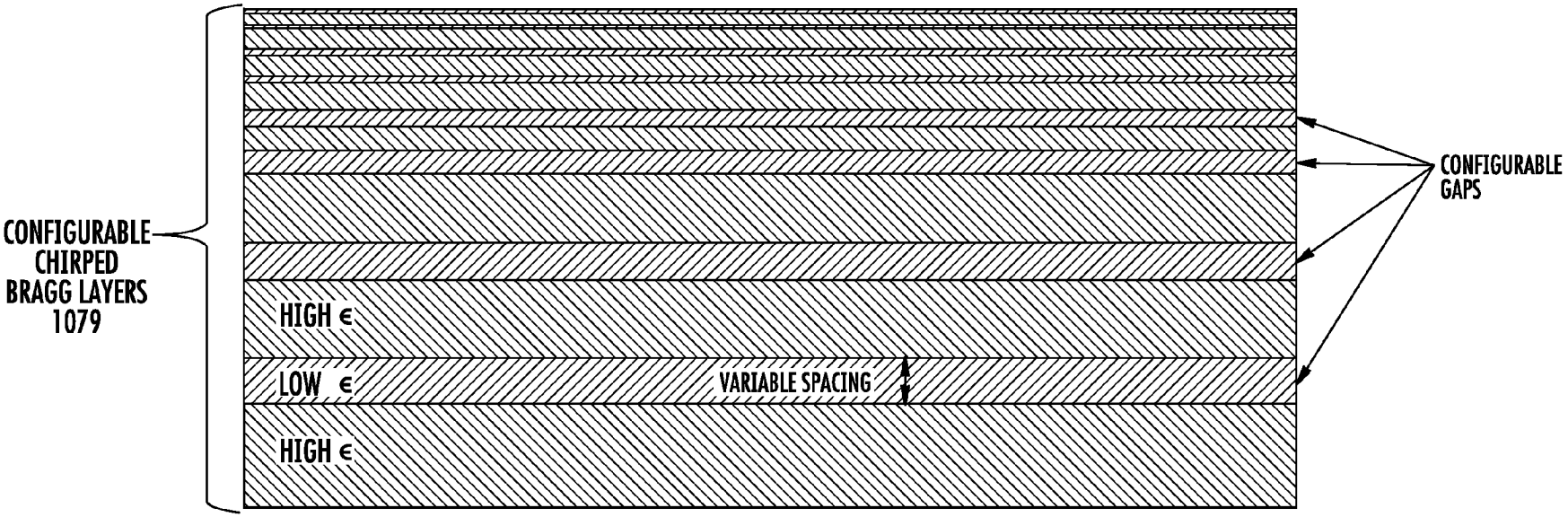
Figure 14:
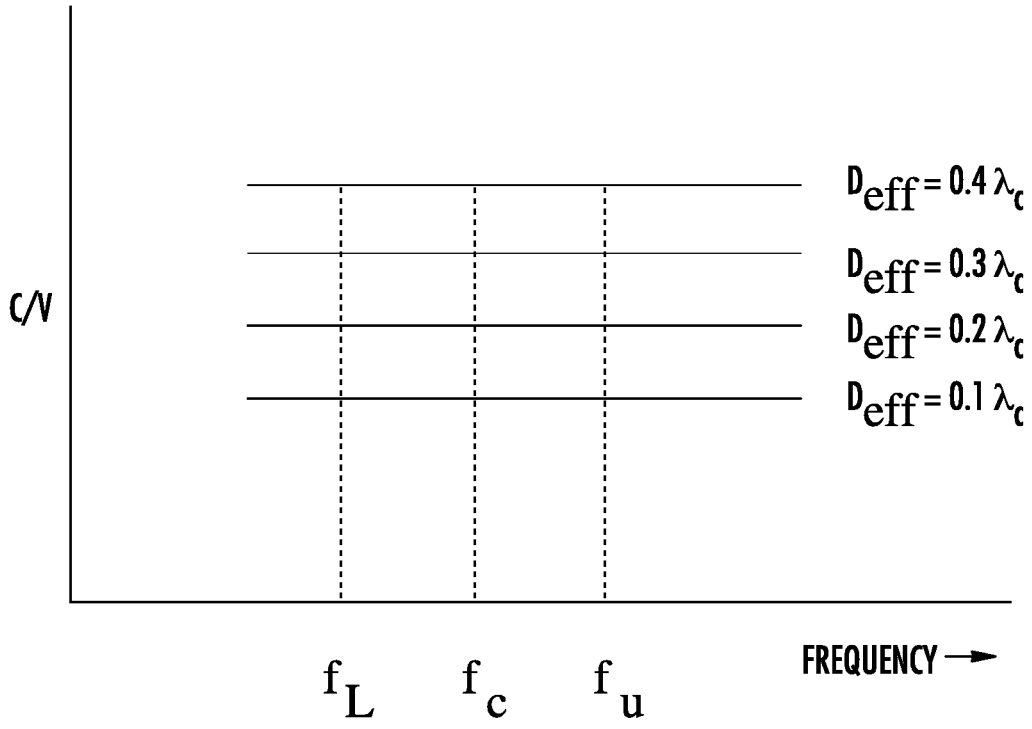
Figure 15:
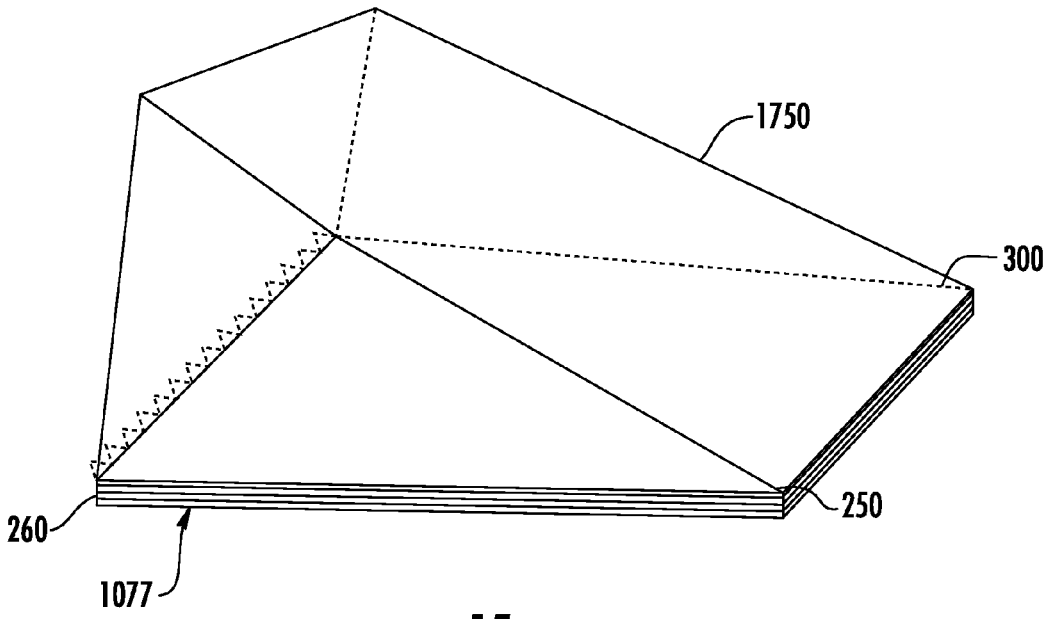

FIG. 15 illustrates yet another embodiment of the antenna array combining various principals as described above. In this implementation, the array consists of a slab 300. The slab 300 may have formed thereon a wedge 1750 much like the wedge 175 described earlier. However, this wedge 1750 covers the surface of a two dimensional slab 300. The slab 300 extends from a feed end 260 to a load end 250 as in other embodiments. The slab 300 may be arranged as any of the slabs 300 explained above, that is with specific individual scattering elements or rods. In a preferred embodiment, the slab 300 is a set of dialelectric layers having adjustable spacing or gaps 1077 there between as was described in connection with FIG. 11.

The feed end 260 may be arranged with a single feed as per FIG. 2-3 or may be with individual multiple feeds as was described in connection with FIG. 2-4. The adjustable gaps in the substrate here provide for adjustment of the beam in an elevational direction and the phase shift applied to the feeds provide for adjustment of the resulting beam in an azimuthal direction. This array arrangement can also be provided with horizontal or vertical polarization and such as by using cross polarization feeds.

Figure 16:
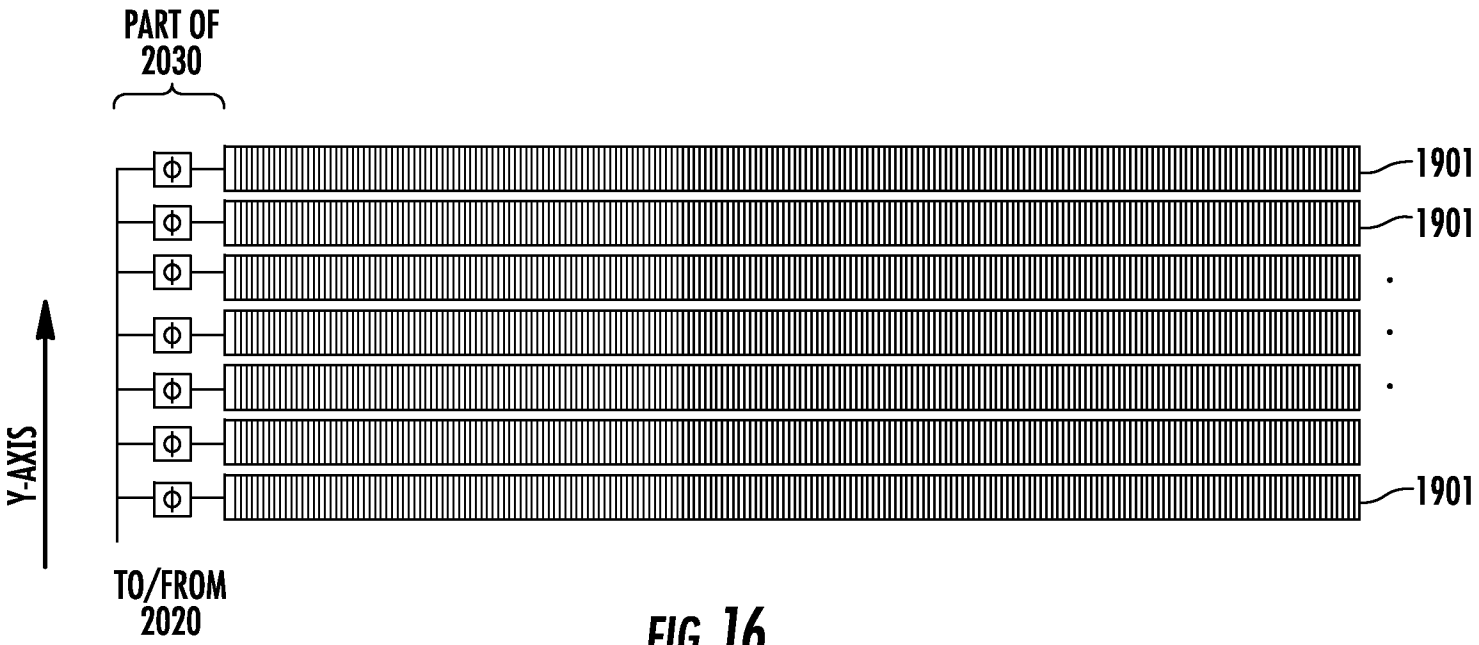
FIG. 16 shows multiple subarrays with different phasing to provide single beam steering.

Beam steering with a single beam in the Y-Axis Field of Regard from 0° to ±90° can be accomplished by arraying the dielectric waveguide antenna line arrays and applying a range of different phase shifts as shown in FIG. 16.

Figure 17:
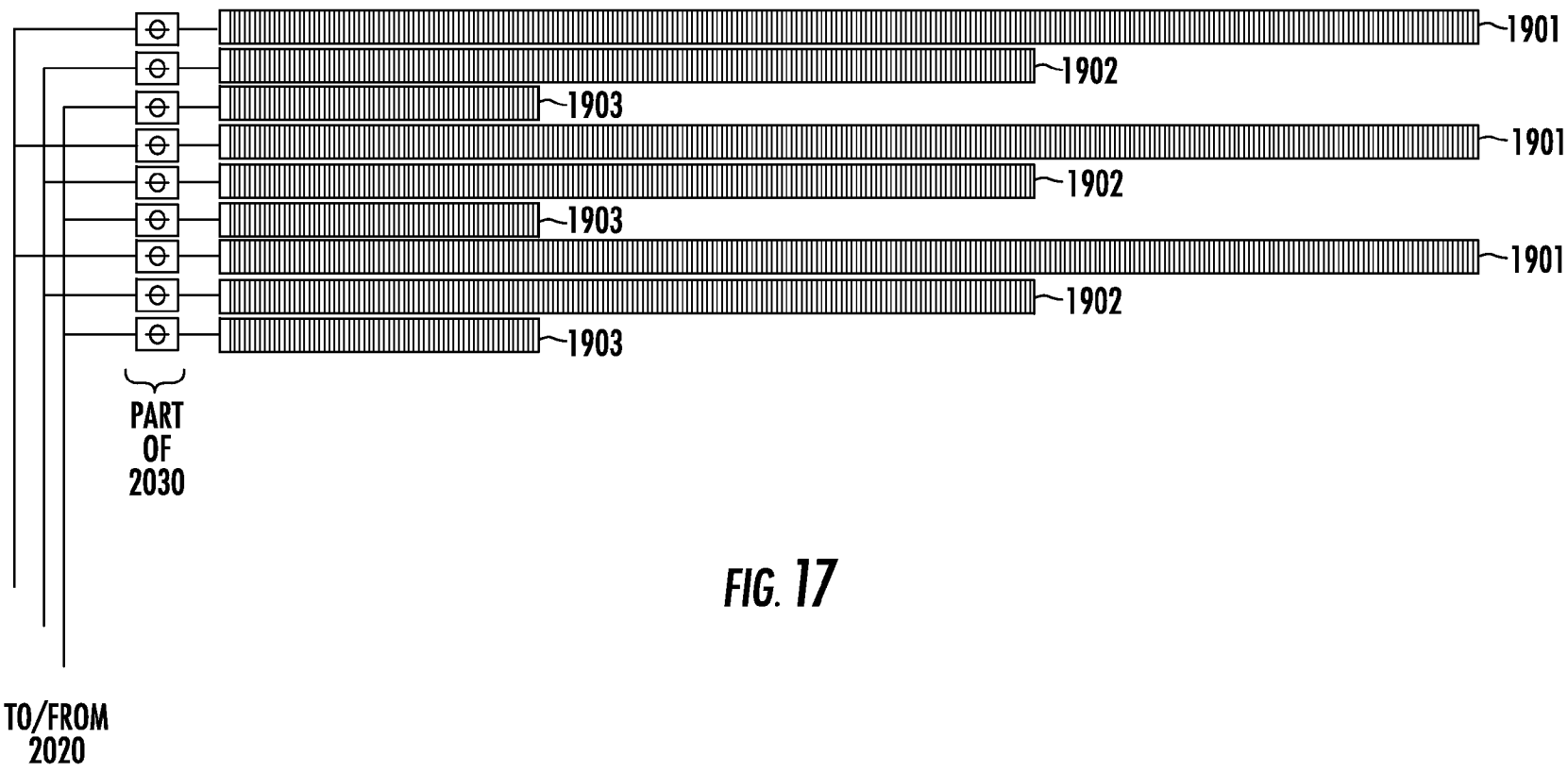
FIG. 17 is an embodiment into interleaved subarrays configured for single beam but multiple frequencies.
Figure 18:
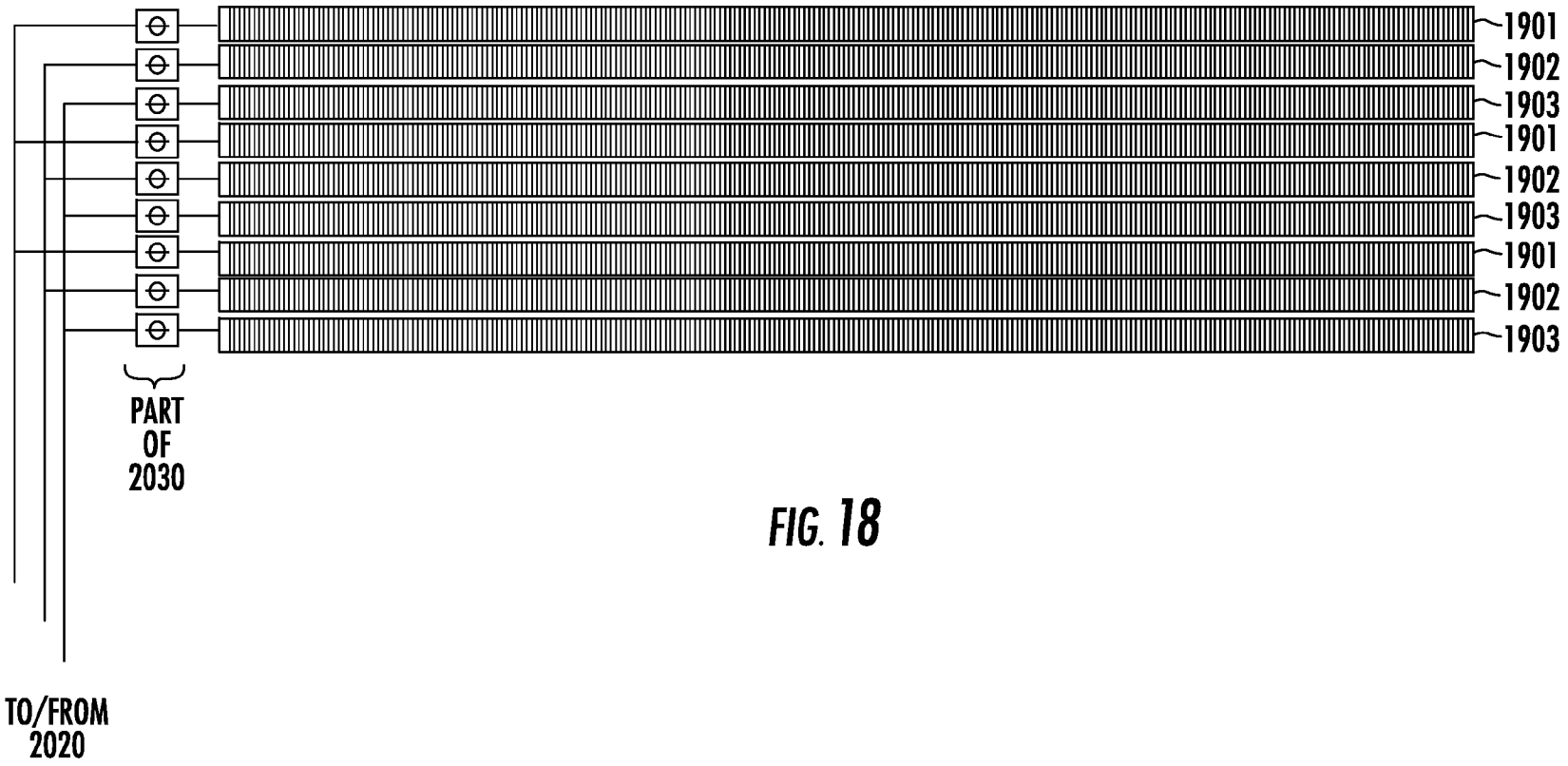
FIG. 18 is a set of line arrays providing multiple beams for a single frequency band.

It is possible to interleave dielectric traveling wave line arrays having different types of surface features, or of different lengths in order to accomplish two (2) different functions: Single Beams for Multiple Frequency Bands (as per FIG. 17) or Multiple Beams for a Single Frequency Band (as per FIG. 18). Beam steering in the Y-Axis Field of Regard (For) from 0° to ±−90° can be achieved as well in these configurations by applying a phase shift to each line array. The use of crossed bowtie surface elements should even allow interleaving of 3 different subarrays 1901, 1902, 1903, each with different types of surface feature types as shown in FIGS. 17 and 18.

This technology is therefore not only suited for a single-band, single or multi-beam application for the Ka-band data link, but is also suited for collocated multiple bands. There is a bandwidth vs. radiation efficiency vs. surface area trade that must be heeded. Single-band, multi-aperture side-by-side arrays (such as shown in FIG. 16) provide high radiation efficiency, are capable of single or multiple beams, but are limited to a single band.

Multi-band interleaved apertures (as per FIGS. 17 and 18), provide high radiation efficiency, but at a larger surface area cost. Multi-aperture (side by side or interleaved bands) also provides a unique capability that a dish antenna cannot provide. With these implementations, band 1 operations can communicate with a first remote receiver or transmitter, while band 2 operations can communicate with a second remote recover or transmitter. It is also possible to communicate with two targets at different locations simultaneously.

The preferred array layout of the dielectric traveling wave line arrays is important depending upon the overall Conception of Operation (Con-Ops) for the particular system of interest. In some cases a multiple beam solution could be more advantageous than a single beam solution if switching speeds are an issue. Additionally, for single beam solutions, it could be useful to have multiple single beams for differing frequency bands as opposed to a single beam across a single frequency band.

Figure 19:
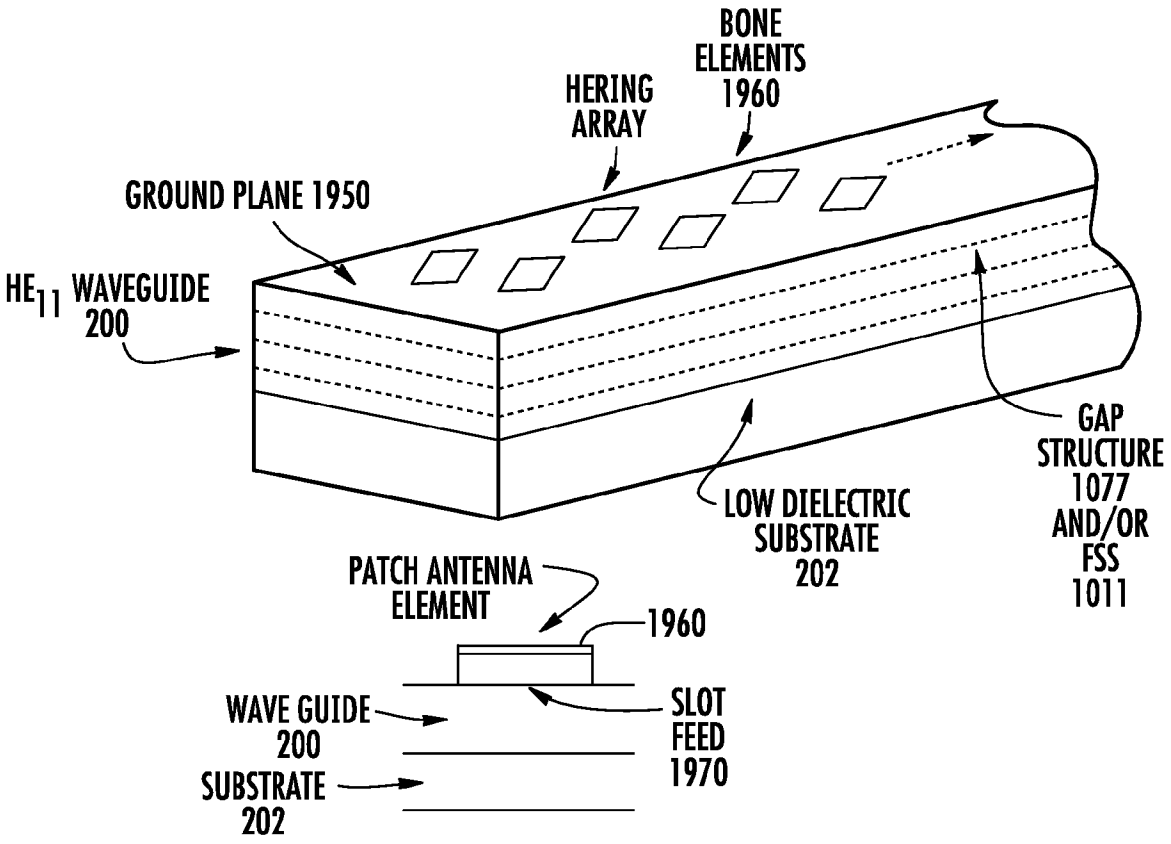
FIG. 19 is an implementation of a subarray using slot fed radiating elements with electronically scanned beams.

In yet another implementation of the—array as shown in FIG. 19, the HE11 mode is employed with a rectangular cross section waveguide 200 with a metallic ground plane 1950 on the top surface. The bottom of the guide 200 is mounted on a low dielectric constant material substrate 202. The surface elements are themselves antenna elements, e.g. patch antennas 1960, mounted on the ground plane surface and fed via slots 1970 in the ground plane. Propagation constant control is accomplished by a gap structure 1980 embedded in the waveguide as per FIG. 11. An FSS structure 1985 may also be embedded in the waveguide. The array elements shown in the FIG. 19 are orthogonal patch antennas configured to generate circular polarization, facilitated by the quarter wave spacing between orthogonal disposed elements in a "herringbone" pattern, such that adjacent rows patch elements 1960 are orthogonal. A TEM mode version is possible with the addition of a ground plane on the bottom of the waveguide.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

The invention claimed is:

1. An antenna array apparatus comprising:

an elongated waveguide having a multi-layer substrate, the substrate having a major axis, a minor axis, an excitation end and a load end, the substrate comprising two or more layers of dielectric material, at least one of the layers being a selected dielectric layer that is spaced apart from an adjacent dielectric layer by an adjustable distance;

a control element, connected to at least one of the dielectric layers, and to thereby electrically scan a radiated beam angle by adjusting the adjustable distance between the selected dielectric layer and the adjacent dielectric layer;

one of the dielectric layers being an outer dielectric layer; and an array of radiating antenna elements disposed on and electrically coupled to the outer dielectric layer at regularly spaced apart positions along the major axis.

2. The apparatus of claim 1 wherein the control element is one of a piezoelectric or electro-active actuator.

3. The apparatus of claim 1 additionally comprising: a wedge layer disposed adjacent the array of radiating elements.

4. The apparatus of claim 1 wherein the multi-layer substrate operates in a TEM propagation mode.

5. The apparatus of claim 1 wherein the dielectric layers further comprise two or more types of dielectric layers, with a first dielectric layer type having a first dielectric constant alternately disposed with layers of a second dielectric layer type having a second dielectric constant, wherein the second dielectric constant is greater than the first dielectric constant.

6. The apparatus of claim 5 wherein at least one of the first or second dielectric layer types is air.

7. The apparatus of claim 1 wherein the spacing between dielectric layers follows a chirp spacing that ranges from one-quarter of a wavelength of a lower frequency of operation to one quarter of a wavelength of a higher frequency of operation.

* * * * *